US009643236B2

(12) United States Patent
Mirchandani et al.

(10) Patent No.: US 9,643,236 B2
(45) Date of Patent: May 9, 2017

(54) THREAD ROLLING DIE AND METHOD OF MAKING SAME

(75) Inventors: Prakash K. Mirchandani, Houston, TX (US); V. Brian Shook, Waynesboro, PA (US); Grayson L. Bowman, Chambersburg, PA (US); Matthew D. Brown, Waynesboro, PA (US)

(73) Assignee: LANDIS SOLUTIONS LLC, Waynesboro, PA (US)

( * ) Notice: Subject to any disclaimer, the term of this patent is extended or adjusted under 35 U.S.C. 154(b) by 848 days.

(21) Appl. No.: 12/616,300

(22) Filed: Nov. 11, 2009

(65) Prior Publication Data

US 2011/0107811 A1 May 12, 2011

(51) Int. Cl.
*B21H 3/04* (2006.01)
*B21H 3/06* (2006.01)

(52) U.S. Cl.
CPC ..... *B21H 3/04* (2013.01); *B21H 3/06* (2013.01)

(58) Field of Classification Search
CPC ... B21H 3/02; B21H 3/06; B21H 3/04; B21H 3/027; B23G 5/04
USPC ..... 72/88, 469, 90; 76/107.1
See application file for complete search history.

(56) References Cited

U.S. PATENT DOCUMENTS 1,509,438 A 9/1924 Miller
1,530,293 A 3/1925 Breitenstein
1,808,136 A 6/1931 Hogg et al.
1,811,802 A 6/1931 Newman
1,912,298 A 5/1933 Newman
2,054,026 A 9/1936 Benninghoff
2,093,507 A 9/1937 Bartek
2,093,742 A 9/1937 Staples
2,093,986 A 9/1937 Staples
2,240,840 A 5/1941 Fischer
2,246,237 A 6/1941 Benninghoff
2,283,280 A 5/1942 Nell
(Continued)

FOREIGN PATENT DOCUMENTS

AU 695583 2/1998
CA 1018474 A 10/1977
(Continued)

OTHER PUBLICATIONS

US 4,966,627, 10/1990, Keshavan et al. (withdrawn)
(Continued)

*Primary Examiner* — Moshe Wilensky
*Assistant Examiner* — Mohammad Yusuf
(74) *Attorney, Agent, or Firm* — Vedder Price PC

(57) ABSTRACT

A thread rolling die includes a thread rolling region comprising a working surface including a thread form. The thread rolling region of the thread rolling die comprises a sintered cemented carbide material having a hardness in the range of 78 HRA to 89 HRA. In certain embodiments, the thread rolling die may further include at least one non-cemented carbide piece metallurgically bonded to the thread rolling region in an area of the thread rolling region that does not prevent a workpiece from contacting the working surface, and wherein the non-cemented carbide piece comprises at least one of a metallic region and a metal matrix composite region. Methods of forming a thread rolling die as embodied herein are also disclosed.

39 Claims, 7 Drawing Sheets

(56) References Cited

U.S. PATENT DOCUMENTS 2,299,207 A 10/1942 Bevillard
2,351,827 A 6/1944 McAllister
2,422,994 A 6/1947 Taylor
2,819,958 A 1/1958 Abkowitz et al.
2,819,959 A 1/1958 Abkowitz et al.
2,906,654 A 9/1959 Abkowitz
2,954,570 A 10/1960 Couch
3,041,641 A 7/1962 Hradek et al.
3,093,850 A 6/1963 Kelso
3,368,881 A 2/1968 Abkowitz et al.
3,471,921 A 10/1969 Feenstra
3,482,295 A 12/1969 Trent
3,490,901 A 1/1970 Hachisuka et al.
3,581,835 A 6/1971 Stebley
3,629,887 A 12/1971 Urbanic
3,660,050 A 5/1972 Iler et al.
3,757,879 A 9/1973 Wilder et al.
3,762,882 A 10/1973 Grutza
3,776,655 A 12/1973 Urbanic
3,782,848 A 1/1974 Pfeifer
3,806,270 A 4/1974 Tanner et al.
3,812,548 A 5/1974 Theuerkaue
3,852,992 A * 12/1974 Yamamoto ..... 72/469
3,889,516 A * 6/1975 Yankee et al. ..... 72/469
RE28,645 E 12/1975 Aoki et al.
3,936,295 A 2/1976 Cromwell et al.
3,942,954 A 3/1976 Frehn
3,980,549 A 9/1976 Grutza
3,987,859 A 10/1976 Lichte
4,009,027 A 2/1977 Naidich et al.
4,017,480 A 4/1977 Baum
4,047,828 A 9/1977 Makely
4,094,709 A 6/1978 Rozmus
4,097,180 A 6/1978 Kwieraga
4,097,275 A 6/1978 Horvath
4,105,049 A 8/1978 Anderson
4,106,382 A 8/1978 Salje et al.
4,126,652 A 11/1978 Oohara et al.
4,128,136 A 12/1978 Generoux
4,170,499 A 10/1979 Thomas et al.
4,181,505 A 1/1980 De Vries et al.
4,198,233 A 4/1980 Frehn
4,221,270 A 9/1980 Vezirian
4,229,638 A 10/1980 Lichte
4,233,720 A 11/1980 Rozmus
4,255,165 A 3/1981 Dennis et al.
4,270,952 A 6/1981 Kobayashi
4,276,788 A 7/1981 van Nederveen
4,277,106 A 7/1981 Sahley
4,277,108 A 7/1981 Wallace
4,306,139 A 12/1981 Shinozaki et al.
4,311,490 A 1/1982 Bovenkerk et al.
4,325,994 A 4/1982 Kitashima et al.
4,327,156 A 4/1982 Dillon et al.
4,331,741 A 5/1982 Wilson
4,340,327 A 7/1982 Martins
4,341,557 A 7/1982 Lizenby
4,351,401 A 9/1982 Fielder
4,376,793 A 3/1983 Jackson
4,396,321 A 8/1983 Holmes
4,398,952 A 8/1983 Drake
4,423,646 A 1/1984 Berhardt
4,478,297 A 10/1984 Radtke
4,497,358 A 2/1985 Gnadig et al.
4,499,048 A 2/1985 Hanejko
4,499,795 A 2/1985 Radtke
4,520,882 A 6/1985 van Nederveen
4,526,748 A 7/1985 Rozmus
4,547,104 A 10/1985 Holmes
4,547,337 A 10/1985 Rozmus
4,550,532 A 11/1985 Fletcher, Jr. et al.
4,552,232 A 11/1985 Frear
4,553,615 A 11/1985 Grainger
4,554,130 A 11/1985 Ecer
4,562,990 A 1/1986 Rose
4,574,011 A 3/1986 Bonjour et al.
4,579,713 A 4/1986 Lueth
4,587,174 A 5/1986 Yoshimura et al.
4,592,685 A 6/1986 Beere
4,596,694 A 6/1986 Rozmus
4,597,730 A 7/1986 Rozmus
4,604,106 A 8/1986 Hall
4,604,781 A 8/1986 Rankin, III
4,605,343 A 8/1986 Hibbs, Jr. et al.
4,609,577 A 9/1986 Long
4,630,693 A 12/1986 Goodfellow
4,642,003 A 2/1987 Yoshimura
4,649,086 A 3/1987 Johnson
4,656,002 A 4/1987 Lizenby et al.
4,662,461 A 5/1987 Garrett
4,667,756 A 5/1987 King et al.
4,686,080 A 8/1987 Hara et al.
4,686,156 A 8/1987 Baldoni, II et al.
4,694,919 A 9/1987 Barr
4,708,542 A 11/1987 Emanuelli
4,722,405 A 2/1988 Langford
4,729,789 A 3/1988 Ide et al.
4,743,515 A 5/1988 Fischer et al.
4,744,943 A 5/1988 Timm
4,749,053 A 6/1988 Hollingshead
4,752,159 A 6/1988 Howlett
4,752,164 A 6/1988 Leonard, Jr.
4,761,844 A 8/1988 Turchan
4,779,440 A 10/1988 Cleve et al.
4,780,274 A 10/1988 Barr
4,804,049 A 2/1989 Barr
4,809,903 A 3/1989 Eylon et al.
4,813,823 A 3/1989 Bieneck
4,831,674 A 5/1989 Bergstrom et al.
4,838,366 A 6/1989 Jones
4,861,350 A 8/1989 Phaal et al.
4,871,377 A 10/1989 Frushour
4,881,431 A 11/1989 Bieneck
4,884,477 A 12/1989 Smith et al.
4,889,017 A 12/1989 Fuller et al.
4,899,838 A 2/1990 Sullivan et al.
4,919,013 A 4/1990 Smith et al.
4,923,512 A 5/1990 Timm et al.
4,934,040 A 6/1990 Turchan
4,943,191 A 7/1990 Schmidtt
4,956,012 A 9/1990 Jacobs et al.
4,968,348 A 11/1990 Abkowitz et al.
4,971,485 A 11/1990 Nomura et al.
4,991,670 A 2/1991 Fuller et al.
5,000,273 A 3/1991 Horton et al.
5,010,945 A 4/1991 Burke
5,030,598 A 7/1991 Hsieh
5,032,352 A 7/1991 Meeks et al.
5,041,261 A 8/1991 Buljan et al.
5,049,450 A 9/1991 Dorfman et al.
RE33,753 E 11/1991 Vacchiano et al.
5,067,860 A 11/1991 Kobayashi et al.
5,075,315 A 12/1991 Rasmussen
5,075,316 A 12/1991 Hubele
5,080,538 A 1/1992 Schmidtt
5,090,491 A 2/1992 Tibbitts et al.
5,092,412 A 3/1992 Walk
5,094,571 A 3/1992 Ekerot
5,096,465 A 3/1992 Chen et al.
5,098,232 A 3/1992 Benson
5,110,687 A 5/1992 Abe et al.
5,112,162 A 5/1992 Hartford et al.
5,112,168 A 5/1992 Glimpel
5,116,659 A 5/1992 Glatzle et al.
5,126,206 A 6/1992 Garg et al.
5,127,776 A 7/1992 Glimpel
5,135,801 A 8/1992 Nyström et al.
5,161,898 A 11/1992 Drake
5,174,700 A 12/1992 Sgarbi et al.
5,179,772 A 1/1993 Braun et al.
5,186,739 A 2/1993 Isobe et al.
5,203,513 A 4/1993 Keller et al.
5,203,932 A 4/1993 Kato et al.
5,217,081 A 6/1993 Waldenström et al.

(56) References Cited

U.S. PATENT DOCUMENTS 5,232,522 A 8/1993 Doktycz et al.
5,250,355 A 10/1993 Newman et al.
5,266,415 A 11/1993 Newkirk et al.
5,273,380 A 12/1993 Musacchia
5,281,260 A 1/1994 Kumar et al.
5,286,685 A 2/1994 Schoennahl et al.
5,305,840 A 4/1994 Liang et al.
5,311,958 A 5/1994 Isbell et al.
5,326,196 A 7/1994 Noll
5,333,520 A 8/1994 Fischer et al.
5,335,738 A 8/1994 Waldenström et al.
5,338,135 A 8/1994 Noguchi et al.
5,346,316 A 9/1994 Okada et al.
5,348,806 A 9/1994 Kojo et al.
5,354,155 A 10/1994 Adams
5,359,772 A 11/1994 Carlsson et al.
5,373,907 A 12/1994 Weaver
5,376,329 A 12/1994 Morgan et al.
5,413,438 A 5/1995 Turchan
5,423,899 A 6/1995 Krall et al.
5,429,459 A 7/1995 Palm
5,438,108 A 8/1995 Umemura et al.
5,438,858 A 8/1995 Friedrichs
5,443,337 A 8/1995 Katayama
5,447,549 A 9/1995 Yoshimura
5,452,771 A 9/1995 Blackman et al.
5,467,669 A 11/1995 Stroud
5,474,407 A 12/1995 Rodel et al.
5,479,997 A 1/1996 Scott et al.
5,480,272 A 1/1996 Jorgensen et al.
5,482,670 A 1/1996 Hong
5,484,468 A 1/1996 Östlund et al.
5,487,626 A 1/1996 Von Holst et al.
5,492,186 A 2/1996 Overstreet et al.
5,496,137 A 3/1996 Ochayon et al.
5,498,142 A 3/1996 Mills
5,505,748 A 4/1996 Tank et al.
5,506,055 A 4/1996 Dorfman et al.
5,518,077 A 5/1996 Blackman et al.
5,525,134 A 6/1996 Mehrotra et al.
5,541,006 A 7/1996 Conley
5,543,235 A 8/1996 Mirchandani et al.
5,544,550 A 8/1996 Smith
5,560,238 A * 10/1996 Allebach et al. ..... 72/13.4
5,560,440 A 10/1996 Tibbitts
5,570,978 A 11/1996 Rees et al.
5,580,666 A 12/1996 Dubensky et al.
5,586,612 A 12/1996 Isbell et al.
5,590,729 A 1/1997 Cooley et al.
5,593,474 A 1/1997 Keshavan et al.
5,601,857 A 2/1997 Friedrichs
5,603,075 A 2/1997 Stoll et al.
5,609,286 A 3/1997 Anthon
5,609,447 A 3/1997 Britzke et al.
5,611,251 A 3/1997 Katayama
5,612,264 A 3/1997 Nilsson et al.
5,628,837 A 5/1997 Britzke et al.
RE35,538 E 6/1997 Akesson et al.
5,641,251 A 6/1997 Leins et al.
5,641,921 A 6/1997 Dennis et al.
5,662,183 A 9/1997 Fang
5,666,864 A 9/1997 Tibbitts
5,672,382 A 9/1997 Lux
5,677,042 A 10/1997 Massa et al.
5,679,445 A 10/1997 Massa et al.
5,686,119 A 11/1997 McNaughton, Jr.
5,697,042 A 12/1997 Massa et al.
5,697,046 A 12/1997 Conley
5,697,462 A 12/1997 Grimes et al.
5,704,736 A 1/1998 Giannetti
5,712,030 A 1/1998 Goto et al.
5,718,948 A 2/1998 Ederyd et al.
5,732,783 A 3/1998 Truax et al.
5,733,078 A 3/1998 Matsushita et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Günter et al.
5,755,298 A 5/1998 Langford, Jr. et al.
5,762,843 A 6/1998 Massa et al.
5,765,095 A 6/1998 Flak et al.
5,776,593 A 7/1998 Massa et al.
5,778,301 A 7/1998 Hong
5,789,686 A 8/1998 Massa et al.
5,791,833 A 8/1998 Niebauer
5,792,403 A 8/1998 Massa et al.
5,803,152 A 9/1998 Dolman et al.
5,806,934 A 9/1998 Massa et al.
5,830,256 A 11/1998 Northrop et al.
5,851,094 A 12/1998 Stand et al.
5,856,626 A 1/1999 Fischer et al.
5,865,571 A 2/1999 Tankala et al.
5,873,684 A 2/1999 Flolo
5,880,382 A 3/1999 Fang et al.
5,890,852 A 4/1999 Gress
5,893,204 A 4/1999 Symonds
5,897,830 A 4/1999 Abkowitz et al.
5,899,257 A 5/1999 Alleweireldt et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,976,707 A 11/1999 Grab et al.
5,988,953 A 11/1999 Berglund et al.
6,007,909 A 12/1999 Rolander et al.
6,012,882 A 1/2000 Turchan
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,076,999 A 6/2000 Hedberg et al.
6,086,003 A 7/2000 Günter et al.
6,086,980 A 7/2000 Foster et al.
6,089,123 A 7/2000 Chow et al.
6,109,377 A 8/2000 Massa et al.
6,109,677 A 8/2000 Anthony
6,117,493 A 9/2000 North
6,135,218 A 10/2000 Deane et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,287 B1 4/2001 Waldenström
6,220,117 B1 4/2001 Butcher
6,227,188 B1 5/2001 Tankala et al.
6,228,134 B1 5/2001 Erickson
6,228,139 B1 5/2001 Oskarrson
6,234,261 B1 5/2001 Evans et al.
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,302,224 B1 10/2001 Sherwood, Jr.
6,326,582 B1 12/2001 North
6,345,941 B1 2/2002 Fang et al.
6,353,771 B1 3/2002 Southland
6,372,346 B1 4/2002 Toth
6,374,932 B1 4/2002 Brady
6,375,706 B2 4/2002 Kembaiyan et al.
6,386,954 B2 5/2002 Sawabe et al.
6,394,711 B1 5/2002 Brosius
6,395,108 B2 5/2002 Eberle et al.
6,402,439 B1 6/2002 Puide et al.
6,425,716 B1 7/2002 Cook
6,450,739 B1 9/2002 Puide et al.
6,453,899 B1 9/2002 Tselesin

(56) References Cited

U.S. PATENT DOCUMENTS 6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,475,647 B1 11/2002 Mendez Acevedo et al.
6,499,917 B1 12/2002 Parker et al.
6,499,920 B2 12/2002 Sawabe
6,500,226 B1 12/2002 Dennis
6,502,623 B1 1/2003 Schmitt
6,511,265 B1 * 1/2003 Mirchandani et al. ..... 407/53
6,544,308 B2 4/2003 Griffin et al.
6,546,991 B2 4/2003 Dworog et al.
6,551,035 B1 4/2003 Bruhn et al.
6,562,462 B2 5/2003 Griffin et al.
6,576,182 B1 6/2003 Ravagni et al.
6,582,126 B2 6/2003 North
6,585,064 B2 7/2003 Griffin et al.
6,585,864 B1 7/2003 Fisher et al.
6,589,640 B2 7/2003 Griffin et al.
6,599,467 B1 7/2003 Yamaguchi et al.
6,607,693 B1 8/2003 Saito et al.
6,607,835 B2 8/2003 Fang et al.
6,637,528 B2 10/2003 Nishiyama et al.
6,648,068 B2 11/2003 Dewey et al.
6,649,682 B1 11/2003 Breton et al.
6,651,757 B2 11/2003 Belnap et al.
6,655,481 B2 12/2003 Findley et al.
6,655,882 B2 12/2003 Heinrich et al.
6,676,863 B2 1/2004 Christiaens et al.
6,682,780 B2 1/2004 Tzatzov et al.
6,685,880 B2 2/2004 Engström et al.
6,688,988 B2 2/2004 McClure
6,695,551 B2 2/2004 Silver
6,706,327 B2 3/2004 Blomstedt et al.
6,716,388 B2 4/2004 Bruhn et al.
6,719,074 B2 4/2004 Tsuda et al.
6,725,953 B2 4/2004 Truax et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,767,505 B2 7/2004 Witherspoon et al.
6,772,849 B2 8/2004 Oldham et al.
6,782,958 B2 8/2004 Liang et al.
6,799,648 B2 10/2004 Brandenberg et al.
6,808,821 B2 10/2004 Fujita et al.
6,844,085 B2 1/2005 Takayama et al.
6,848,521 B2 2/2005 Lockstedt et al.
6,849,231 B2 2/2005 Kojima et al.
6,899,495 B2 5/2005 Hansson et al.
6,918,942 B2 7/2005 Hatta et al.
6,932,172 B2 8/2005 Dvorachek
6,933,049 B2 8/2005 Wan et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,017,677 B2 3/2006 Keshavan et al.
7,036,611 B2 5/2006 Radford et al.
7,044,243 B2 5/2006 Kembaiyan et al.
7,048,081 B2 5/2006 Smith et al.
7,070,666 B2 7/2006 Druschitz et al.
7,080,998 B2 7/2006 Hall et al.
7,090,731 B2 8/2006 Kashima et al.
7,101,128 B2 9/2006 Hansson
7,101,446 B2 9/2006 Takeda et al.
7,112,143 B2 9/2006 Muller
7,125,207 B2 10/2006 Craig et al.
7,128,773 B2 10/2006 Liang et al.
7,147,413 B2 12/2006 Henderer et al.
7,152,701 B2 12/2006 Butland et al.
7,159,429 B2 * 1/2007 Takemasu ..... B21H 3/02 470/10
7,172,142 B2 2/2007 Taylor et al.
7,175,404 B2 2/2007 Kondo et al.
7,192,660 B2 3/2007 Ruppi
7,204,117 B2 4/2007 Friedrichs
7,207,401 B2 4/2007 Dewey et al.
7,216,727 B2 5/2007 Wardley
7,231,984 B2 6/2007 Jaensch
7,234,541 B2 6/2007 Scott et al.
7,234,550 B2 6/2007 Azar et al.
7,235,211 B2 6/2007 Griffo et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.
7,267,187 B2 9/2007 Kembaiyan
7,267,543 B2 9/2007 Freidhoff et al.
7,270,679 B2 9/2007 Istephanous et al.
7,296,497 B2 11/2007 Kugelberg et al.
7,350,599 B2 4/2008 Lockwood et al.
7,381,283 B2 6/2008 Lee et al.
7,384,413 B2 6/2008 Gross et al.
7,384,443 B2 6/2008 Mirchandani et al.
7,395,882 B2 7/2008 Oldham et al.
7,410,610 B2 8/2008 Woodfield et al.
7,487,849 B2 2/2009 Radtke
7,494,507 B2 2/2009 Dixon
7,497,280 B2 3/2009 Brackin et al.
7,497,396 B2 3/2009 Splinter et al.
7,513,320 B2 4/2009 Mirchandani et al.
7,524,351 B2 4/2009 Hua et al.
7,556,668 B2 7/2009 Eason et al.
7,575,620 B2 8/2009 Terry et al.
7,625,157 B2 12/2009 Prichard et al.
7,632,323 B2 12/2009 Ganguly et al.
7,661,491 B2 2/2010 Kembaiyan et al.
7,687,156 B2 3/2010 Fang
7,703,555 B2 4/2010 Overstreet
7,810,588 B2 10/2010 McClain et al.
7,832,456 B2 11/2010 Calnan et al.
7,832,457 B2 11/2010 Calnan et al.
7,846,551 B2 12/2010 Fang et al.
7,887,747 B2 * 2/2011 Iwasaki et al. ..... 419/15
7,954,569 B2 6/2011 Mirchandani et al.
8,025,112 B2 9/2011 Mirchandani et al.
8,087,324 B2 1/2012 Mirchandani et al.
8,109,177 B2 2/2012 Kembaiyan et al.
8,137,816 B2 3/2012 Fang et al.
8,141,665 B2 3/2012 Ganz
8,225,886 B2 7/2012 Mirchandani et al.
2002/0004105 A1 1/2002 Kunze et al.
2003/0010409 A1 1/2003 Kunze et al.
2003/0041922 A1 3/2003 Hirose et al.
2003/0219605 A1 11/2003 Molian et al.
2004/0013558 A1 1/2004 Kondoh et al.
2004/0105730 A1 6/2004 Nakajima
2004/0129403 A1 7/2004 Liu et al.
2004/0228695 A1 11/2004 Clauson
2004/0234820 A1 11/2004 Majagi
2004/0244540 A1 12/2004 Oldham et al.
2004/0245022 A1 12/2004 Izaguirre et al.
2004/0245024 A1 12/2004 Kembaiyan
2005/0008524 A1 1/2005 Testani
2005/0019114 A1 1/2005 Sung
2005/0025928 A1 2/2005 Annanolli et al.
2005/0084407 A1 4/2005 Myrick
2005/0103404 A1 5/2005 Hsieh et al.
2005/0117984 A1 6/2005 Eason et al.
2005/0194073 A1 9/2005 Hamano et al.
2005/0211475 A1 9/2005 Mirchandani et al.
2005/0247491 A1 11/2005 Mirchandani et al.
2005/0268746 A1 12/2005 Abkowitz et al.
2006/0016521 A1 1/2006 Hanusiak et al.
2006/0032677 A1 2/2006 Azar et al.
2006/0043648 A1 3/2006 Takeuchi et al.
2006/0060392 A1 3/2006 Eyre

(56) References Cited

U.S. PATENT DOCUMENTS

| | | | |
|---|---|---|---|
| 2006/0185773 | A1 | 8/2006 | Chiovelli |
| 2006/0286410 | A1 | 12/2006 | Ahlgren et al. |
| 2006/0288820 | A1 | 12/2006 | Mirchandani et al. |
| 2007/0082229 | A1 | 4/2007 | Mirchandani et al. |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0102202 | A1 | 5/2007 | Choe et al. |
| 2007/0108650 | A1 | 5/2007 | Mirchandani et al. |
| 2007/0110607 | A1 | 5/2007 | Iwasaki et al. |
| 2007/0126334 | A1 | 6/2007 | Nakamura et al. |
| 2007/0163679 | A1 | 7/2007 | Fujisawa et al. |
| 2007/0193782 | A1 | 8/2007 | Fang et al. |
| 2008/0011519 | A1 | 1/2008 | Smith et al. |
| 2008/0101977 | A1 | 5/2008 | Eason et al. |
| 2008/0145686 | A1 | 6/2008 | Mirchandani et al. |
| 2008/0163723 | A1 | 7/2008 | Mirchandani et al. |
| 2008/0196318 | A1 | 8/2008 | Bost et al. |
| 2008/0302576 | A1 | 12/2008 | Mirchandani et al. |
| 2009/0032501 | A1 | 2/2009 | Swingley et al. |
| 2009/0041612 | A1 | 2/2009 | Fang et al. |
| 2009/0136308 | A1 | 5/2009 | Newitt |
| 2009/0180915 | A1 | 7/2009 | Mirchandani et al. |
| 2009/0293672 | A1 | 12/2009 | Mirchandani et al. |
| 2009/0301788 | A1 | 12/2009 | Stevens et al. |
| 2010/0044114 | A1 | 2/2010 | Mirchandani et al. |
| 2010/0044115 | A1 | 2/2010 | Mirchandani et al. |
| 2010/0278603 | A1 | 11/2010 | Fang et al. |
| 2010/0290849 | A1 | 11/2010 | Mirchandani et al. |
| 2010/0323213 | A1 | 12/2010 | Aitchison et al. |
| 2011/0011965 | A1 | 1/2011 | Mirchandani et al. |
| 2011/0265623 | A1 | 11/2011 | Mirchandani et al. |
| 2011/0284179 | A1 | 11/2011 | Stevens et al. |
| 2011/0287238 | A1 | 11/2011 | Stevens et al. |
| 2011/0287924 | A1 | 11/2011 | Stevens |
| 2012/0285293 | A1 | 11/2012 | Mirchandani et al. |
| 2012/0321498 | A1 | 12/2012 | Mirchandani |
| 2013/0025127 | A1 | 1/2013 | Mirchandani et al. |
| 2013/0025813 | A1 | 1/2013 | Mirchandani et al. |
| 2013/0026274 | A1 | 1/2013 | Mirchandani et al. |
| 2013/0028672 | A1 | 1/2013 | Mirchandani et al. |
| 2013/0036872 | A1 | 2/2013 | Mirchandani et al. |
| 2013/0037985 | A1 | 2/2013 | Mirchandani |
| 2013/0043615 | A1 | 2/2013 | Mirchandani et al. |
| 2013/0048701 | A1 | 2/2013 | Mirchandani et al. |
| 2013/0075165 | A1 | 3/2013 | Coleman et al. |

FOREIGN PATENT DOCUMENTS

| | | | |
|---|---|---|---|
| CA | 1158073 | A | 12/1983 |
| CA | 1250156 | A | 2/1989 |
| CA | 2022065 | A1 | 2/1991 |
| CA | 2120332 | | 6/1993 |
| CA | 2107004 | C | 5/1996 |
| CA | 2228398 | A1 | 2/1997 |
| CA | 2198985 | A1 | 9/1998 |
| CA | 2108274 | C | 7/2000 |
| CA | 2212197 | C | 10/2000 |
| CA | 2201969 | C | 2/2003 |
| CA | 2213169 | C | 3/2005 |
| CA | 2498073 | A1 | 8/2006 |
| CA | 2556132 | A1 | 2/2007 |
| CA | 2570937 | A1 | 6/2007 |
| CA | 2357407 | C | 1/2008 |
| CN | 101263236 | A | 9/2008 |
| DE | 19634314 | A1 | 1/1998 |
| DE | 10300283 | B3 | 6/2004 |
| DE | 102006030661 | A1 | 1/2008 |
| EP | 0157625 | A2 | 10/1985 |
| EP | 0264674 | A2 | 4/1988 |
| EP | 0453428 | A1 | 10/1991 |
| EP | 0641620 | B1 | 2/1998 |
| EP | 0995876 | A2 | 4/2000 |
| EP | 1065021 | A1 | 1/2001 |
| EP | 1066901 | A2 | 1/2001 |
| EP | 1106706 | A1 | 6/2001 |
| EP | 0759480 | B1 | 1/2002 |
| EP | 1244531 | B1 | 10/2004 |
| EP | 1686193 | A2 | 8/2006 |
| FR | 2627541 | A2 | 8/1989 |
| GB | 622041 | | 4/1949 |
| GB | 945227 | | 12/1963 |
| GB | 1309634 | | 3/1973 |
| GB | 1420906 | | 1/1976 |
| GB | 1491044 | | 11/1977 |
| GB | 2064619 | A | 6/1981 |
| GB | 2158744 | A | 11/1985 |
| GB | 1082568 | | 9/1987 |
| GB | 2218931 | A | 11/1989 |
| GB | 2315452 | A | 2/1998 |
| GB | 2324752 | A | 11/1998 |
| GB | 2352727 | A | 2/2001 |
| GB | 2364745 | A | 8/2003 |
| GB | 2385350 | A | 8/2003 |
| GB | 2393449 | A | 3/2004 |
| GB | 2397832 | A | 8/2004 |
| GB | 2435476 | A | 8/2007 |
| JP | 51-124876 | A | 10/1976 |
| JP | 56-52604 | U | 5/1981 |
| JP | 59-54510 | A | 3/1984 |
| JP | 59-56501 | A | 4/1984 |
| JP | 59-67333 | A | 4/1984 |
| JP | 59-169707 | A | 9/1984 |
| JP | 59-175912 | A | 10/1984 |
| JP | 60-48207 | A | 3/1985 |
| JP | 60-172403 | A | 9/1985 |
| JP | 61-226231 | A | 10/1986 |
| JP | 61-243103 | A | 10/1986 |
| JP | 61057123 | B | 12/1986 |
| JP | 63-34710 | A | 2/1987 |
| JP | 62-063005 | A | 3/1987 |
| JP | 62-278250 | A | 3/1987 |
| JP | 62-218010 | A | 9/1987 |
| JP | 1-171725 | A | 7/1989 |
| JP | 2-95506 | A | 4/1990 |
| JP | 2-269515 | A | 11/1990 |
| JP | 3-43112 | A | 2/1991 |
| JP | 3-73210 | A | 3/1991 |
| JP | 5-50314 | A | 3/1993 |
| JP | 5-92329 | A | 4/1993 |
| JP | H05-64288 | U | 8/1993 |
| JP | H03-119090 | U | 6/1995 |
| JP | 7-276105 | A | 10/1995 |
| JP | 8-120308 | A | 5/1996 |
| JP | H8-209284 | | 8/1996 |
| JP | 8-294805 | A | 11/1996 |
| JP | 9-11005 | A | 1/1997 |
| JP | 9-192930 | A | 7/1997 |
| JP | 9-253779 | A | 9/1997 |
| JP | 10-138033 | A | 5/1998 |
| JP | 10219385 | A | 8/1998 |
| JP | H10-511740 | A | 11/1998 |
| JP | 11-10409 | A | 1/1999 |
| JP | 11-300516 | A | 11/1999 |
| JP | 2000-237910 | A | 9/2000 |
| JP | 2000-296403 | A | 10/2000 |
| JP | 2000-355725 | A | 12/2000 |
| JP | 2002-097885 | A | 4/2002 |
| JP | 2002-166326 | A | 6/2002 |
| JP | 2002-317596 | A | 10/2002 |
| JP | 2003-306739 | A | 10/2003 |
| JP | 2004-514065 | A | 5/2004 |
| JP | 2004-160591 | A | 6/2004 |
| JP | 2004-181604 | | 7/2004 |
| JP | 2004-190034 | A | 7/2004 |
| JP | 2005-111581 | A | 4/2005 |
| KR | 20050055268 | | 6/2005 |
| RU | 2135328 | C1 | 8/1999 |
| RU | 2173241 | C2 | 2/2000 |
| RU | 2167262 | C2 | 5/2001 |
| SU | 967786 | A1 | 10/1982 |
| SU | 975369 | A1 | 11/1982 |
| SU | 990423 | A1 | 1/1983 |
| SU | 1269922 | A | 11/1986 |

(56) References Cited

FOREIGN PATENT DOCUMENTS

| | | | |
|---|---|---|---|
| SU | 1292917 | A1 | 2/1987 |
| SU | 1350322 | | 11/1987 |
| UA | 6742 | | 12/1994 |
| UA | 63469 | C2 | 1/2006 |
| UA | 23749 | U | 6/2007 |
| WO | WO 92/05009 | A1 | 4/1992 |
| WO | WO 92/22390 | A1 | 12/1992 |
| WO | WO 97/34726 | A1 | 9/1997 |
| WO | WO 98/28455 | A1 | 7/1998 |
| WO | WO 99/13121 | A1 | 3/1999 |
| WO | WO 00/43628 | A2 | 7/2000 |
| WO | WO 00/52217 | A1 | 9/2000 |
| WO | WO 01/43899 | A1 | 6/2001 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A1 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104001 | A1 | 10/2006 |
| WO | WO 2007/001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |
| WO | WO 2008/098636 | A1 | 6/2008 |
| WO | WO 2008/115703 | A1 | 9/2008 |
| WO | WO 2011/008439 | A2 | 1/2011 |

OTHER PUBLICATIONS

ASTM G65-04 Publish Date from http://infostore.saiglobal.com.*
Advisory Action mailed Jun. 29, 2009 in U.S. Appl. No. 10/903,198.
ASM Materials Engineering Dictionary, J. R. Davis, Ed., ASM International, Fifth printing (Jan. 2006), p. 98.
Coyle, T.W. and A. Bahrami, "Structure and Adhesion of Ni and Ni—WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.
Deng, X. et al., "Mechanical Properties of a Hybrid Cemented Carbide Composite," International Journal of Refractory Metals and Hard Materials, Elsevier Science Ltd., vol. 19, 2001, pp. 547-552.
Gurland, J. *Quantitative Microscopy*, R.T. DeHoff and F.N. Rhines, eds., McGraw-Hill Book Company, New York, 1968, pp. 279-290.
Gurland, Joseph, "Application of Quantitative Microscopy to Cemented Carbides," Practical Applications of Quantitative Matellography, ASTM Special Technical Publication 839, ASTM 1984, pp. 65-84.
Hayden, Matthew and Lyndon Scott Stephens, "Experimental Results for a Heat-Sink Mechanical Seal," Tribology Transactions, 48, 2005, pp. 352-361.
Metals Handbook, vol. 16 Machining, "Tapping" (ASM International 1989), pp. 255-267.
Notice of Allowance issued on Jan. 27, 2009 in U.S. Appl. No. 11/116,752.
Notice of Allowance mailed Oct. 21, 2002 in U.S. Appl. No. 09/460,540.
Notice of Allowance issued on Nov. 13, 2008 in U.S. Appl. No. 11/206,368.
Notice of Allowance issued on Nov. 26, 2008 in U.S. Appl. No. 11/013,842.
Notice of Allowance issued on Nov. 30, 2009 in U.S. Appl. No. 11/206,368.
Notice of Allowance issued on Jan. 26, 2010 in U.S. Appl. No. 11/116,752.
Office Action (Advisory Action) mailed Mar. 15, 2002 in U.S. Appl. No. 09/460,540.
Office Action (final) mailed Dec. 1, 2001 in U.S. Appl. No. 09/460,540.
Office Action (non-final) mailed Jun. 1, 2001 in U.S. Appl. No. 09/460,540.
Office Action (non-final) mailed Jun. 18, 2002 in U.S. Appl. No. 09/460,540.
Office Action issued on Aug. 12, 2008 in U.S. Appl. No. 11/116,752.
Office Action issued on Jul. 9, 2009 in U.S. Appl. No. 11/116,752.
Office Action issued on Aug. 31, 2007 in U.S. Appl. No. 11/206,368.
Office Action issued on Feb. 28, 2008 in U.S. Appl. No. 11/206,368.
Office Action issued on Jan. 15, 2008 in U.S. Appl. No. 11/116,752.
Office Action issued on Jan. 16, 2007 in U.S. Appl. No. 11/013,842.
Office Action issued on Jan. 24, 2008 in U.S. Appl. No. 10/848,437.
Office Action issued on Jul. 16, 2008 in U.S. Appl. No. 11/013,842.
Office Action issued on Jul. 30, 2007 in U.S. Appl. No. 11/013,842.
Office Action mailed Apr. 30, 2009 in U.S. Appl. No. 11/206,368.
Office Action mailed Oct. 31, 2008 in U.S. Appl. No. 10/903,198.
Office Action mailed Apr. 17, 2009 in U.S. Appl. No. 10/903,198.
Peterman, Walter, "Heat-Sink Compound Protects the Unprotected," Welding Design and Fabrication, Sep. 2003, pp. 20-22.
Pre-Appeal Brief Conference Decision issued on May 14, 2008 in U.S. Appl. No. 10/848,437.
Pre-Appeal Conference Decision issued on Jun. 19, 2008 in U.S. Appl. No. 11/206,368.
Restriction Requirement issued on Sep. 8, 2006 in U.S. Appl. No. 10/848,437.
Sriram, et al., "Effect of Cerium Addition on Microstructures of Carbon-Alloyed Iron Aluminides," Bull. Mater. Sci., vol. 28, No. 6, Oct. 2005, pp. 547-554.
Tracey et al., "Development of Tungsten Carbide-Cobalt—Ruthenium Cutting Tools for Machining Steels" Proceedings Annual Microprogramming Workshop, vol. 14, 1981, pp. 281-292.
Underwood, *Quantitative Stereology*, pp. 23-108 (1970).
U.S. Appl. No. 12/464,607, filed May 12, 2009.
U.S. Appl. No. 12/502,277, filed Jul. 14, 2009.
Office Action mailed Mar. 12, 2009 in U.S. Appl. No. 11/585,408.
Office Action mailed Sep. 22, 2009 in U.S. Appl. No. 11/585,408.
Office Action mailed Sep. 7, 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Aug. 17, 2011 in U.S. Appl. No. 11/585,408.
Notice of Allowance mailed May 9, 2012 in U.S. Appl. No. 11/585,408.
Restriction Requirement mailed Jul. 24, 2008 in U.S. Appl. No. 11/167,811.
Office Action mailed Oct. 21, 2008 in U.S. Appl. No. 11/167,811.
Final Office Action mailed Jun. 12, 2009 in U.S. Appl. No. 11/167,811.
Office Action mailed Aug. 28, 2009 in U.S. Appl. No. 11/167,811.
Office Action mailed Mar. 2, 2010 in U.S. Appl. No. 11/167,811.
Office Action mailed Aug. 19, 2010 in U.S. Appl. No. 11/167,811.
Advisory Action Before the Filing of an Appeal Brief mailed May 12, 2010 in U.S. Appl. No. 11/167,811.
Office Action mailed Feb. 3, 2011 in U.S. Appl. No. 11/167,811.
Advisory Action mailed May 11, 2011 in U.S. Appl. No. 11/167,811.
Office Action mailed Jul. 22, 2011 in U.S. Appl. No. 11/167,811.
Office Action mailed Mar. 28, 2012 in U.S. Appl. No. 11/167,811.
Office Action mailed Mar. 19, 2009 in U.S. Appl. No. 11/737,993.
Office Action mailed Jun. 3, 2009 in U.S. Appl. No. 11/737,993.
Office Action mailed Dec. 9, 2009 in U.S. Appl. No. 11/737,993.
Office Action mailed Feb. 24, 2010 in U.S. Appl. No. 11/737,993.
Office Action mailed Jun. 29, 2010 in U.S. Appl. No. 11/737,993.
Advisory Action Before the Filing of an Appeal Brief mailed Sep. 9, 2010 in U.S. Appl. No. 11/737,993.
Pre-Brief Appeal Conference Decision mailed Nov. 22, 2010 in U.S. Appl. No. 11/737,993.
Office Action mailed Apr. 20, 2011 in U.S. Appl. No. 11/737,993.
Office Action mailed Aug. 3, 2011 in U.S. Appl. No. 11/737,993.
Office Action mailed Oct. 11, 2011 in U.S. Appl. No. 11/737,993.
Office Action mailed Jan. 6, 2012 in U.S. Appl. No. 11/737,993.
Advisory Action Before the Filing of an Appeal Brief mailed Mar. 22, 2012 in U.S. Appl. No. 11/737,993.

(56) References Cited

OTHER PUBLICATIONS

Restriction Requirement mailed Sep. 17, 2010 in U.S. Appl. No. 12/397,597.
Office Action mailed Nov. 15, 2010 in U.S. Appl. No. 12/397,597.
Office Action mailed Jun. 7, 2011 in U.S. Appl. No. 12/397,597.
Advisory Action Before the Filing of an Appeal Brief mailed Aug. 31, 2011 in U.S. Appl. No. 12/397,597.
Office Action mailed Nov. 17, 2011 in U.S. Appl. No. 12/397,597.
Advisory Action mailed Jan. 26, 2012 in U.S. Appl. No. 12/397,597.
Office Action mailed Apr. 13, 2012 in U.S. Appl. No. 12/397,597.
Office Action mailed Dec. 29, 2005 in U.S. Appl. No. 10/903,198.
Office Action mailed Sep. 29, 2006 in U.S. Appl. No. 10/903,198.
Office Action mailed Mar. 27, 2007 in U.S. Appl. No. 10/903,198.
Office Action mailed Sep. 26, 2007 in U.S. Appl. No. 10/903,198.
Examiner's Answer mailed Aug. 17, 2010 in U.S. Appl. No. 10/903,198.
Office Action mailed Apr. 22, 2010 in U.S. Appl. No. 12/196,951.
Office Action mailed Oct. 29, 2010 in U.S. Appl. No. 12/196,951.
Office Action mailed Apr. 12, 2011 in U.S. Appl. No. 12/196,951.
Office Action mailed Oct. 19, 2011 in U.S. Appl. No. 12/196,951.
Office Action mailed Mar. 19, 2012 in U.S. Appl. No. 12/196,951.
Office Action mailed Oct. 13, 2011 in U.S. Appl. No. 12/179,999.
Notice of Allowance mailed Apr. 30, 2012 in U.S. Appl. No. 12/179,999.
Office Action mailed Aug. 29, 2011 in U.S. Appl. No. 12/476,738.
Office Action mailed Dec. 21, 2011 in U.S. Appl. No. 12/476,736.
Notice of Allowance mailed Apr. 17, 2012 in U.S. Appl. No. 12/476,738.
Office Action mailed Nov. 14, 2011 in U.S. Appl. No. 12/502,277.
Office Action mailed Jan. 20, 2012 in U.S. Appl. No. 12/502,277.
Office Action mailed Mar. 15, 2012 in U.S. Appl. No. 12/464,607.
Notice of Allowance mailed Apr. 9, 2012 in U.S. Appl. No. 12/464,607.
Office Action mailed Oct. 31, 2011 in U.S. Appl. No. 13/207,478.
Office Action mailed Mar. 2, 2012 in U.S. Appl. No. 13/207,478.
Notice of Allowance mailed Apr. 13, 2012 in U.S. Appl. No. 13/207,478.
Office Action mailed Dec. 5, 2011 in U.S. Appl. No. 13/182,474.
Office Actton mailed Apr. 27, 2012 in U.S. Appl. No. 13/182,474.
Office Action mailed May 14, 2009 in U.S. Appl. No. 11/687,343.
Office Action mailed Jan. 21, 2010 in U.S. Appl. No. 11/687,343.
Notice of Allowance mailed May 18, 2010 in U.S. Appl. No. 11/687,343.
Restriction Requirement mailed Aug. 4, 2010 in U.S. Appl. No. 12/198,815.
Office Action mailed Oct. 27, 2010 in U.S. Appl. No. 12/196,815.
Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16, 2011 in U.S. Appl. No. 12/196,815.
Office Action mailed Sep. 2, 2011 in U.S. Appl. No. 12/850,003.
Notice of Allowance mailed Nov. 15, 2011 in U.S. Appl. No. 12/850,003.
Office Action mailed May 3, 2010 in U.S. Appl. No. 11/924,273.
Office Action mailed Oct. 14, 2010 in U.S. Appl. No. 11/924,273.
Office Action mailed Feb. 2, 2011 in U.S. Appl. No 11/924,273.
Interview Summary mailed Feb. 16, 2011 in U.S. Appl. No. 11/924,273.
Interview Summary mailed May 9, 2011 in U.S. Appl. No. 11/924,273.
Notice of Allowance mailed Jun. 24, 2011 in U.S. Appl. No. 11/924,273.
Metals Handbook, vol. 16 Machining, "Cemented Carbides" (ASM International 1989), pp. 71-89.
Shi et al., "Composite Ductility—The Role of Reinforcement and Matrix", TMS Meeting, Las Vegas, NV, Feb. 12-16, 1995, 10 pages.
Vander Vort. "Introduction to Quantitative Metallography", Tech Notes, vol. 1, Issue 5, published by Buehler, Ltd. 1997, 6 pages.
You Tube, "The Story Behind Kennemetal's Beyond Blast", dated Sep. 14, 2010, http://www.youtube.com/watch?v=8_A-bYVwmU8 (3 pages) accessed on Oct. 14, 2010.
Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.
Pages from Kennametal site, https://www.kennametal.com/en-US/promotions/Beyond_Blast.jhtml (7 pages) accessed on Oct. 14, 2010.
Childs et al., "Metal Machining", 2000, Elsevier, p. 111.
Brookes, Kenneth J. A., "World Directory and Handbook of Hardmetals and Hard Materials", International Carbide Data, U.K. 1996, Sixth Edition, p. 42.
Firth Sterling grade chart, Allegheny Technologies, attached to Declaration of Prakash Mirchandani, Ph.D. as filed in U.S. Appl. No. 11/737,993 on Sep. 9, 2009.
Metals Handbook Desk Edition, definition of 'wear', 2nd Ed., J.R. Davis, Editor, ASM International 1998, p. 62.
McGraw-Hill Dictionary of Scientific and Technical Terms, 5th Edition, Sybil P. Parker, Editor in Chief, 1993, pp. 799, 800, 1933, and 2047.
ProKon Version 8.6, The Calculation Companion, Properties for W, Ti, Mo, Co, Ni and Fe, Copyright 1997-1998, 6 pages.
TIBTECH Innovations, "Properties table of stainless steel, metals and other conductive materials", printed from http://www.tibtech.com/conductivity.php on Aug. 19, 2011, 1 page.
"Material: Tungsten Carbide (WC), bulk", MEMSnet, printed from http://www.memsnet.org/material/tungstencarbidewcbulk/ on Aug. 19, 2001, 1 page.
Williams, Wendell S., "The Thermal Conductivity of Metallic Ceramics", JOM, Jun. 1998, pp. 62-66.
Brookes, Kenneth J. A., "World Directory and Handbook of Hardmetals and Hard Materials", International Carbide Data, U.K. 1996, Sixth Edition, pp. D182-D184.
Thermal Conductivity of Metals, The Engineering ToolBox, printed from http://www.engineeringtoolbox.com/thermal-conductivity-metals-d_858.html on Oct. 27, 2011, 3 pages.
The Thermal Conductivity of Some Common Materials and Gases, The Engineering ToolBox, printed from http://www.engineeringtoolbox.com/thermal-conductivity-d_429.html on Dec. 15, 2011, 4 pages.
Tool and Manufacturing Engineers Handbook, Fourth Edition, vol. 1, Machining, Society of Manufacturing Engineers, Chapter 12, vol. 1, 1983, pp. 12-110-12-114.
Beard, T. "The INS and OUTS of Thread Milling: Emphasis: Hole Making, Interview", Modern Machine Shop, Gardner Publications. Inc. 1991, vol. 64, No. 1, 5 pages.
Koelsch, J., "Thread Milling Takes on Tapping", Manufacturing Engineering, 1995, vol. 115, No. 4, 6 pages.
Johnson, M. "Tapping", Traditional Machining Processes, 1997, pp. 255-265.
"Thread Milling", Traditional Machining Processes 1997, pp. 268-269.
Scientific Cutting Tools, "The Cutting Edge", 1998, printed on Feb. 1, 2000, 15 pages.
Helical Carbide Thread Mills, Schmarje Tool Company, 1998, 2 pages.
Office Action mailed Jan. 16, 2008 in U.S. Appl. No. 10/903,198.
Notice of Allowance mailed Jul. 16, 2012 in U.S. Appl. No. 12/484,607.
Pyrotek, Zyp Zircwash, www.pyrotek.info, Feb. 2003, 1 page.
Sims et al., "Casting Engineering", Superalloys II, Aug. 1987, pp. 420-426.
Sikkenga, "Cobalt and Cobalt Alloy Castings", Casting, vol. 15, ASM Handbook, ASM International, 2008, pp. 1114-1118.
Starck, H.C., Surface Technology, Powders for PTA-Welding, Lasercladding and other Wear Protective Welding Applcations, Jan. 2011, 4 pages.
Office Action mailed Feb. 27, 2013 in U.S. Appl. No. 13/550,690.
Office Action mailed Jan. 23, 2013 in U.S. Appl. No. 13/652,508.
Office Action mailed Feb. 5, 2013 in U.S. Appl. No. 13/652,503.
Office Action mailed Apr. 5, 2013 in U.S. Appl. No. 13/632,177.

(56) References Cited

OTHER PUBLICATIONS

Restriction Requirement mailed Jan. 3, 2013 in U.S. Appl. No. 13/632,178.
Office Action mailed Mar. 6, 2013 in U.S. Appl. No. 13/632,178.
Office Action mailed Oct. 4, 2012 in U.S. Appl. No. 13/491,638.
Notice of Allowance mailed Mar. 6, 2013 in U.S. Appl. No. 13/491,638.
Office Action mailed Jun. 28, 2012 in U.S. Appl. No. 13/222,324.
Office Action mailed Jul. 11, 2012 in U.S. Appl. No. 13/222,324.
Office Action mailed Nov. 6, 2012 in U.S. Appl. No. 13/222,324.
Corrected Notice of Allowability mailed Jun. 21, 2012 in U.S. Appl. No. 12/476,738.
Notice of Allowance mailed Jul. 18, 2012 in U.S. Appl. No. 13/182,474.
Notice of Reopening of Prosecution Due to Consideration of an Information Disclosure Statement Filed After Mailing of a Notice of Allowance mailed Oct. 10, 2012 in U.S. Appl. No. 13/182,474.
Notice of Allowance mailed Jul. 16, 2012 in U.S. Appl. No. 12/464,607.
Supplemental Notice of Allowability mailed Jun. 29, 2012 in U.S. Appl. No. 13/207,478.
Notice of Allowance mailed Jul. 20, 2012 in U.S. Appl. No. 11/585,408.
Corrected Notice of Allowability mailed Oct. 18, 2012 in U.S. Appl. No. 11/585,408.
Notice of Allowance mailed Jul. 25, 2012 in U.S. Appl. No. 11/737,993.
Notice of Allowance mailed Jul. 31, 2012 in U.S. Appl. No. 12/196,951.
Notice of Allowance mailed Jul. 10, 2012 in U.S. Appl. No. 12/502,277.
Supplemental Notice of Allowability mailed Jul. 20, 2012 in U.S. Appl. No. 12/502,277.
Wang, Jicai et al., "Research and Development Status of Particulate Reinforced Metal Matrix Composites," Cemented Carbide, vol. 20 (1).
K-4543USMX1 Office Action dated Jun. 16, 2014.
K-4543USCN1 Office Action dated Dec. 18, 2013 with attached Search Report.
Mexican Patent Appln. MX/a/2012/004858—Non Final Rejection.
Society of Manufacturing Engineers (SME); Tool and Manufacturing Engineers Handbook; 1983; Chapter 2—pp. 48, 49, 54, 81-83, 108-110, 114, 115 and 126-133; vol. 1—Machining.

* cited by examiner

THREAD ROLLING DIE AND METHOD OF MAKING SAME

BACKGROUND OF THE TECHNOLOGY

Field of the Technology

The present disclosure is directed to thread rolling dies used for producing threads on one machine component in order to fasten it to another machine component, and to methods of manufacturing thread rolling dies. More specifically, the disclosure is directed to thread rolling dies comprising sintered cemented carbide thread rolling regions, and to methods of making the thread rolling dies.

Description of the Background of the Technology

Threads are commonly used as a means of fastening one machine component to another. Machining techniques such as turning, using single point or form tools, and grinding, using single contact or form wheels, are employed as metal removal methods to create the desired thread geometry in a workpiece. These methods are commonly referred to as thread cutting methods.

Thread cutting techniques suffer from some inherent disadvantages. Thread cutting techniques are generally slow and costly, and require the use of expensive machine tools, including special tooling. The thread cutting techniques are not cost-effective for processing large production batches. Because thread cutting involves machining a blank, waste material in the form of cut chips is produced. Additionally, the finish of cut threads may be less than desirable.

An alternative method of forming threads in machine components involves the use of "chipless" metal forming techniques, i.e., thread forming techniques in which the workpiece is not cut and chips are not formed. An example of a chipless thread forming technique is the thread rolling technique. The thread rolling technique involves rolling threads onto a cylindrical metal component positioned between two or more thread rolling dies including a working surface having a mirror-image of the desired thread geometry. Traditionally, thread rolling dies may be circular or flat. The thread geometry is created on a workpiece as it is compressed between the dies and the dies move relative to one another. Circular thread rolling dies are rotated relative to one another. Flat thread rolling dies are moved in a linear or reciprocating fashion relative to one another. Thread rolling is therefore a method of cold forming, or moving rather than removing the workpiece material to form the threads. This is illustrated schematically in FIGS. 1A and 1B. FIG. 1A schematically illustrates a thread rolling die positioned on a side surface of a cylindrical blank, and FIG. 1(*b*) schematically illustrates the final product produced by rotating the blank relative to the die. As indicated in FIGS. 1A and 1B, the process of moving the material of the blank upward and outward to form the threads results in a major thread diameter (FIG. 1A) that is greater than the blank diameter (FIG. 1B).

Thread rolling offers several advantages over machining or cutting techniques for forming threads on a workpiece. For example, a significant amount of material may be saved from becoming waste because of the "chipless" nature of the thread rolling technique. Also, because thread rolling forms the threads by flowing the material upward and outward, the blank may be smaller than that required for when forming the threads by thread cutting, resulting in additional material savings. In addition, thread rolling can produce threads and related forms at high threading speeds and with longer comparable tool life. Therefore, thread rolling is a viable technique for high volume production. Thread rolling also is cold forming technique in which there is no abrasive wear, and the thread rolling dies can operate throughout their useful life without the need for periodic sizing.

Thread rolling also results in a significant increase in the hardness and yield strength of the material in the thread region of the workpiece due to work hardening caused by the compressive forces exerted during the thread rolling operation. Thread rolling can produce threads that are, for example, up to 20% stronger than cut threads. Rolled threads also exhibit reduced notch sensitivity and improved fatigue resistance. Thread rolling, which is a cold forming technique, also typically results in threads having excellent microstructure, a smooth mirror surface finish, and improved grain structure for higher strength.

Advantages of thread rolling over thread cutting are illustrated schematically in FIGS. 2A and 2B. FIG. 2A schematically shows microstructural flow lines in a thread region of a workpiece resulting from thread cutting. FIG. 2B schematically shows microstructural flow lines in a thread region of a workpiece resulting from thread rolling. The figures suggest that no material waste is produced by thread rolling, which relies on movement of the workpiece material to produce the threads. The flow lines shown in FIG. 2B also suggest the hardness improvement and strength increase produced by flowing of material in thread rolling.

Conventional thread rolling dies are typically made from high speed steels as well as other tool steels. Thread rolling dies made from steels have several limitations. The compressive strength of high speed steels and tool steels may not be significantly higher than the compressive strength of common workpiece materials such as alloy steels and other structural alloys. In fact, the compressive strength of conventional thread rolling die materials may be lower than the compressive strength of high strength workpiece materials such as, for example, nickel-base and titanium-base aerospace alloys and certain corrosion resistant alloys. In general, the compressive yield strength of tool steels used to make thread rolling dies falls bellow about 275,000 psi. When the compressive strength of the thread rolling die material does not substantially exceed the compressive strength of the workpiece material, the die is subject to excessive plastic deformation and premature failure.

In addition to having relatively high compressive strength, thread rolling die materials should possess substantially greater stiffness than the workpiece material. In general, however, the high speed steels and tool steels that are currently used in thread rolling dies do not possess stiffness that is higher than common workpiece materials. The stiffness (i.e., Young's Modulus) of these tool steels falls below about $32\times10^6$ psi. Thread rolling dies made from these high speed steels and tool steels may undergo excessive elastic deformation during the thread rolling process, making it difficult to hold close tolerances on the thread geometry.

In addition, thread rolling dies made from high speed steels and tool steels can be expected to exhibit only modestly higher wear resistance compared to many common workpiece materials. For example, the abrasion wear volume of certain tool steels used in thread rolling dies, measured as per ASTM G65-04, "Standard Test Method for Measuring Abrasion Using the Dry Sand/Rubber Wheel Apparatus", is about 100 $mm^3$. Therefore, die lifetime may be limited due to excessive wear.

Accordingly, there is a need for thread rolling dies made from materials that exhibit superior combinations of strength, particularly compressive strength, stiffness, and wear resistance compared to high speed and other tool steels conventionally used in thread rolling dies. Such materials would provide increased die service life and also may allow the dies to be used to produce threads on workpiece materials that cannot readily be processed using conventional dies.

SUMMARY

In a non-limiting embodiment according to the present disclosure, a thread rolling die comprises a thread rolling region including a working surface comprising a thread form. The thread rolling region comprises a sintered cemented carbide material having a hardness in the range of 78 HRA to 89 HRA.

In another non-limiting embodiment according to the present disclosure, a thread rolling die comprises a thread rolling region including a working surface comprising a thread form, wherein the thread rolling region includes a sintered cemented carbide material having at least one of a compressive yield strength of at least 400,000 psi; a Young's modulus in the range of $50\times10^6$ psi to $80\times10^6$ psi; an abrasion wear volume in the range of 5 $mm^3$ to 30 $mm^3$ evaluated according to ASTM G65-04; a fracture toughness of at least 15 $ksi\cdot in^{1/2}$; and a transverse rupture strength of at least 300 ksi.

In yet another non-limiting embodiment according to this disclosure, a thread rolling die comprises a thread rolling region including a working surface comprising a thread form, wherein at least the working surface of the thread rolling region comprises a sintered cemented carbide material. In certain non-limiting embodiments, the thread rolling die includes at least one non-cemented carbide piece metallurgically bonded to the thread rolling region in an area of the thread rolling region that does not prevent the working surface from contacting a workpiece. In certain non-limiting embodiments, the non-cemented carbide piece comprises at least one of a metallic region and a metal matrix composite region.

In yet another non-limiting embodiment according to the present disclosure, a thread rolling die comprises a thread rolling region including a working surface comprising a thread form, and a non-cemented carbide piece metallurgically bonded to the thread rolling region, wherein at least the working surface of the thread rolling region comprises a sintered cemented carbide material having at least one of a compressive yield strength of at least 400,000 psi; a Young's modulus in the range of $50\times10^6$ psi to $80\times10^6$ psi; an abrasion wear volume in the range of 5 $mm^3$ to 30 $mm^3$ evaluated according to ASTM G65-04; a hardness in the range of 78 HRA to 89 HRA; a fracture toughness of at least 15 $ksi\cdot in^{1/2}$; and a transverse rupture strength of at least 300 ksi.

BRIEF DESCRIPTION OF THE DRAWINGS

The features and advantages of articles and methods described herein may be better understood by reference to the accompanying drawings in which.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the articles and methods according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Figure 1A:
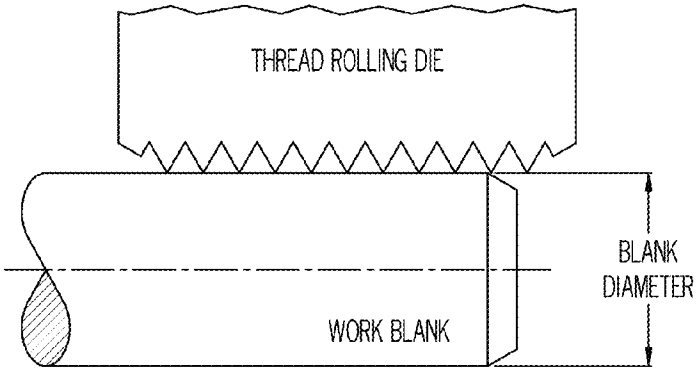
FIG. 1A (PRIOR ART)
FIGS. 1A and 1B are schematic representations showing certain aspects of a conventional thread rolling process.
Figure 1B:
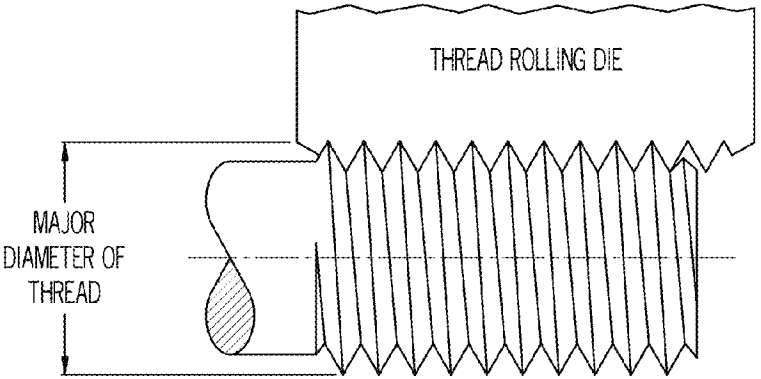
FIG. 1B (PRIOR ART)
Figure 2A:
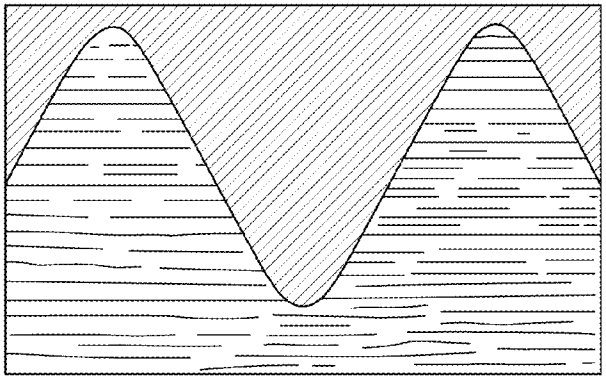
FIG. 2A (PRIOR ART)
FIGS. 2A and 2B are schematic representations of the microstructural flow lines of the workpiece material in a thread form region of a workpiece formed by r thread cutting and thread rolling, respectively.
Figure 2B:
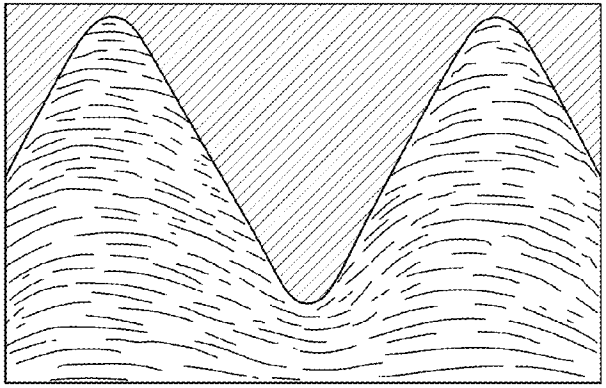
FIG. 2B (PRIOR ART)
Figure 3:
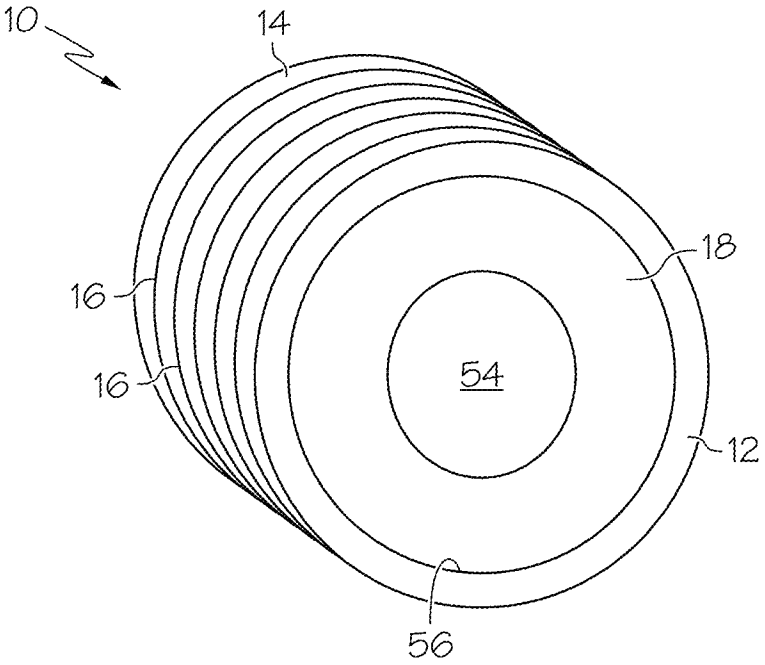
FIG. 3 is a schematic representation of one non-limiting embodiment of a circular thread rolling die according to the present disclosure, wherein the die includes a non-cemented carbide region and a sintered cemented carbide working surface having a hardness in the range of 78 HRA to 89 HRA (Rockwell Hardness Scale "A")
Figure 4:
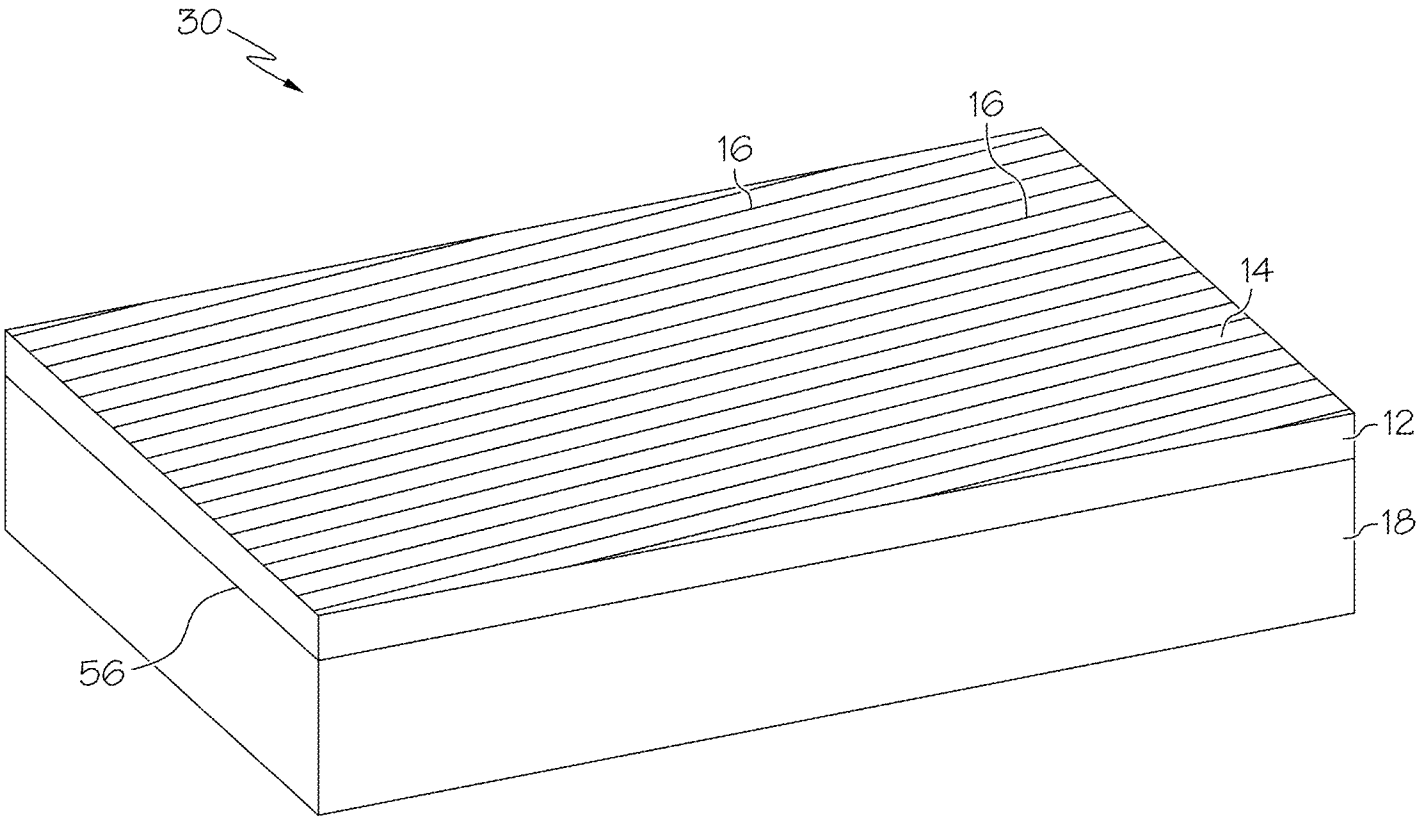
FIG. 4 is a schematic representation of one non-limiting embodiment of a flat thread rolling die according to the present disclosure, wherein the die includes a non-cemented carbide region and a sintered cemented carbide working surface having a hardness in the range of 78 HRA to 89 HRA.
Figure 5:
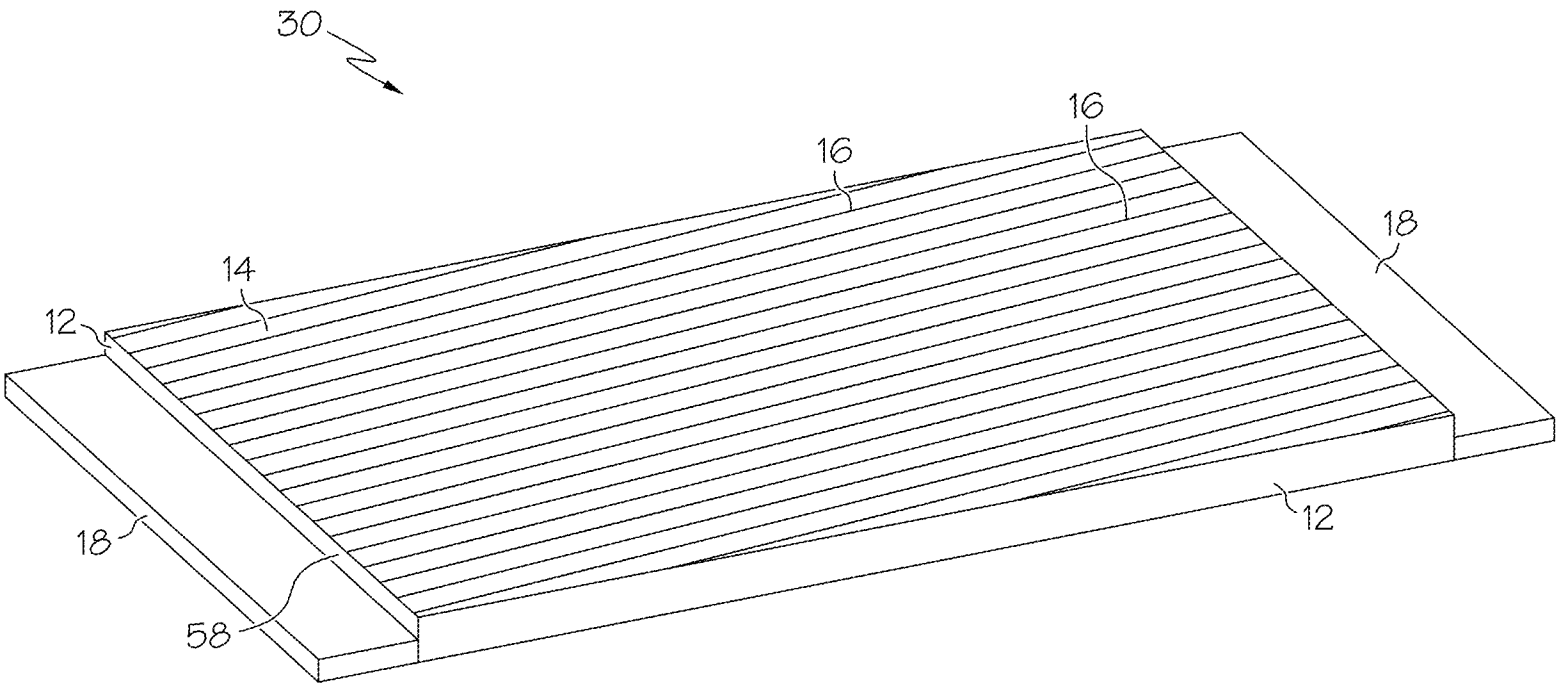
FIG. 5 is a schematic representation of an additional non-limiting embodiment of a flat thread rolling die according to the present disclosure, wherein the die includes two non-cemented carbide regions and a sintered cemented carbide working surface having a hardness in the range of 78 HRA to 89 HRA.

One non-limiting embodiment of a circular thread rolling die 10 according to the present disclosure is depicted in FIG. 3. Non-limiting embodiments of a flat thread rolling die 30 according to the present disclosure are depicted in FIGS. 4 and 5. It will be understood that although the specific embodiments of novel and inventive thread rolling dies depicted and described herein are circular or flat thread rolling dies, the present invention also encompasses additional thread rolling die configurations, whether known now or hereinafter to a person of ordinary skill in the art. Each of thread rolling dies 10, 30 include a thread rolling region 12 comprising a working surface 14, which is the surface of the thread rolling die that contacts a workpiece and forms threads thereon. As such, the working surface 14 includes a thread form 16. The thread rolling region 12 of each of dies 10, 30 comprises a sintered cemented carbide material. According to certain embodiments, the sintered cemented carbide has a hardness in the range of 78 HRA to 89 HRA.

In a non-limiting embodiment, the sintered cemented carbide material of the thread rolling region 12 may have a compressive yield strength of at least 400,000 psi. In another non-limiting embodiment, the sintered cemented carbide material of the thread rolling region 12 may have a Young's modulus of at least $50\times10^6$ psi. A non-limiting embodiment of the thread rolling die 10 comprises a sintered cemented carbide thread rolling region 12, wherein the sintered cemented carbide material has a Young's modulus in the range of $50\times10^6$ psi to $80\times10^6$ psi. In still another non-limiting embodiment, the sintered cemented carbide material of the thread rolling region 12 may have an abrasion wear volume no greater than 30 $mm^3$ as evaluated according to ASTM G65-04. In one non-limiting embodiment, the sintered cemented carbide material of the thread rolling region 12 has an abrasion wear volume in the range of 5 $mm^3$ to 30 $mm^3$ as evaluated according to ASTM G65-04.

According to one non-limiting embodiment of a thread rolling die 10, 30 according to the present disclosure, the sintered cemented carbide material of the thread rolling region 12 may have a combination of properties including a compressive yield strength of at least 400,000 psi; a Young's modulus of at least $50\times10^6$ psi; and an abrasion wear volume no greater than 30 $mm^3$ evaluated according to ASTM G65-04. In another non-limiting embodiment, the sintered cemented carbide material of the thread rolling region 12 may have a fracture toughness of at least 15 $ksi\cdot in^{1/2}$. In still another non-limiting embodiment, the sintered cemented carbide material of the thread rolling region 12 may have a transverse rupture strength of at least 300 ksi.

According to certain other non-limiting embodiments, the sintered cemented carbide material of the thread rolling region 12 of thread rolling dies 10, 30 has one or more of a compressive yield strength of at least 400,000 psi; a Young's modulus in the range of $50\times10^6$ psi to $80\times10^6$ psi; an abrasion wear volume in the range of 5 $mm^3$ to 30 $mm^3$ as evaluated according to ASTM G65-04; a hardness in the range of 78 HRA to 89 HRA; a fracture toughness of at least 15 $ksi\cdot in^{1/2}$; and a transverse rupture strength of at least 300 ksi.

According to certain non-limiting embodiments according to the present disclosure, the thread form 16 of the working surface 14 of thread rolling dies 10, 30 may include one of V-type threads, Acme threads, Knuckle threads, and Buttress threads. It will be understood, however, that such thread form patterns are not exhaustive and that any suitable thread form known now or here hereafter to a person skilled in the art may be included on a thread rolling die according to the present disclosure.

In certain non-limiting embodiments, sintered cemented carbide included in the thread rolling region and, optionally, sintered cemented carbide material included in other regions of the thread rolling dies according to the present disclosure are made using conventional powder metallurgy techniques. Such techniques include, for example: mechanically or isostatically pressing a blend of metal powders to form a "green" part having a desired shape and size; optionally, heat treating or "presintering" the green part at a temperature in the range of 400° C. to 1200° C. to provide a "brown" part; optionally, machining the part in the green or brown state to impart certain desired shape features; and heating the part at a sintering temperature, for example, in the range of 1350° C. to 1600° C. Other techniques and sequences of steps for providing sintered cemented carbide material will be evident to those having ordinary skill in the art. In appropriate circumstances, one or more of such other techniques may be used to provide sintered cemented carbide material included in thread rolling dies according to the present disclosure, and it will become evident to those having ordinary skill, upon reading the present disclosure, how to adapt such one or more techniques for use in providing the present thread rolling dies.

In certain non-limiting embodiments of thread rolling dies according to the present disclosure, sintered cemented carbide material included in the thread rolling dies according to the present disclosure may be finish-machined using operations such, for example, turning, milling, grinding, and electro-discharge machining. Also, in certain non-limiting embodiments of thread rolling dies according to the present disclosure, finish-machined material included in the thread rolling dies may be coated with materials providing wear resistance and/or other advantageous characteristics. Such coatings may be applied using conventional coating techniques such as, for example, chemical vapor deposition (CVD) and/or physical vapor deposition (PVD). Non-limiting examples of wear resistant materials that may be provided as a coating on all or a region of cemented carbide materials included in thread rolling dies according to the present disclosure include $Al_2O_3$, TiC, Ti(C,N), either in single layers or in combinations of multiple layers. Other possible materials that may be provided as coatings on cemented carbide materials, either as a single-layer or as part of a multiple-layer coating, included in thread rolling dies according to the present disclosure will be known to those having ordinary skill and are encompassed herein.

In certain non-limiting embodiments, cemented carbide material included in the thread rolling region of thread rolling dies according to the present disclosure includes a discontinuous, dispersed phase and a continuous binder phase. The discontinuous, dispersed phase includes hard particles of a carbide compound of at least one metal selected from Groups IVB, a Group VB, or a Group VIB of the Periodic Table. Such metals include, for example, titanium, zirconium, hafnium, vanadium, niobium, tantalum, chromium, molybdenum, and tungsten. The continuous binder phase comprises one or more of cobalt, a cobalt alloy, nickel, a nickel alloy, iron, and an iron alloy. In certain non-limiting embodiments, the sintered cemented carbide material included in the thread rolling region comprises 60 weight percent up to 98 weight percent of the dispersed phase and 2 weight percent to 40 weight percent of the continuous binder phase. According to certain non-limiting embodiment, hard carbide particles of the dispersed phase have an average grain size in the range of 0.3 μm to 20 μm.

In a non-limiting embodiment, the continuous binder phase of sintered cemented carbide material included in the thread rolling region of a thread rolling die according to the present disclosure comprises at least one additive selected from tungsten, chromium, titanium, vanadium, niobium and carbon in a concentration up to the solubility limit of the additive in the continuous binder phase. In certain non-limiting embodiments, the continuous binder phase of sintered cemented carbide material in the thread rolling region comprises at least one additive selected from silicon, boron, aluminum copper, ruthenium, and manganese in a total concentration of up to 5% by weight, based on the total weight of the continuous binder phase.

In certain non-limiting embodiments of thread rolling dies according to the present disclosure, the working surface of the thread rolling region comprises sintered cemented carbide material having a surface hardness in the range of 78 HRA to 89 HRA. Grades of sintered cemented having this particular surface hardness include, but are not limited to, grades including a dispersed, discontinuous phase including tungsten carbide particles and a continuous binder phase comprising cobalt. Various commercially available powder blends used to produce grades of sintered cemented carbide materials are known to those of ordinary skill and may be obtained from various sources such as, for example, ATI Engineered Products, Grant, Ala., USA. Non-limiting examples of commercially available cemented carbide grades that may be used in various embodiments of thread rolling dies according to the present disclosure include ATI Firth Grades FL10, FL15, FL20, FL25, FL30, FL35, H20, H25, ND20, ND25, ND30, H71, R52, and R61. The various cemented carbide grades typically differ in one or more of carbide particle composition, carbide particle grain size, binder phase volume fraction, and binder phase composition, and these variations influence the final physical and mechanical properties of the sintered cemented carbide material.

FIGS. 3-6 schematically illustrate certain non-limiting embodiments of thread rolling dies according to the present disclosure. Each of thread rolling dies 10, 30, 40 includes a thread rolling region 12, 42 comprising a working surface 14, 44 which, in turn, includes a thread form 16 (not shown in FIG. 6). Each of thread rolling dies 10, 30, 40 also includes a non-working region 18 that supports the thread rolling region 12. With reference to the thread rolling die 40 of FIG. 6, in certain embodiments, the non-working region 18 comprises the same sintered cemented carbide material as the thread rolling region 42 or may comprise one or more layers, such as layers 46, 48, 50, and 52, of other grades of cemented carbide material. In certain other non-limiting die embodiments, the non-working region 18 may comprise at least one cemented carbide material that differs in at least one characteristic from sintered cemented carbide material included in the thread rolling region of the die. The at least one characteristic that differs may be selected from, for example, composition and a physical or mechanical property. Physical and/or mechanical properties that may differ include, but are not limited to, compressive yield strength, Young's modulus, hardness, toughness, wear resistance, and transverse rupture strength. In certain embodiments of a thread rolling die according to the present disclosure, the die may include different grades of cemented carbide material in different regions of the thread rolling die, selected to provide desired properties such as, for example, compressive yield strength, Young's modulus, hardness, toughness, wear resistance, and transverse rupture strength, in particular regions of the die.

Figure 6:
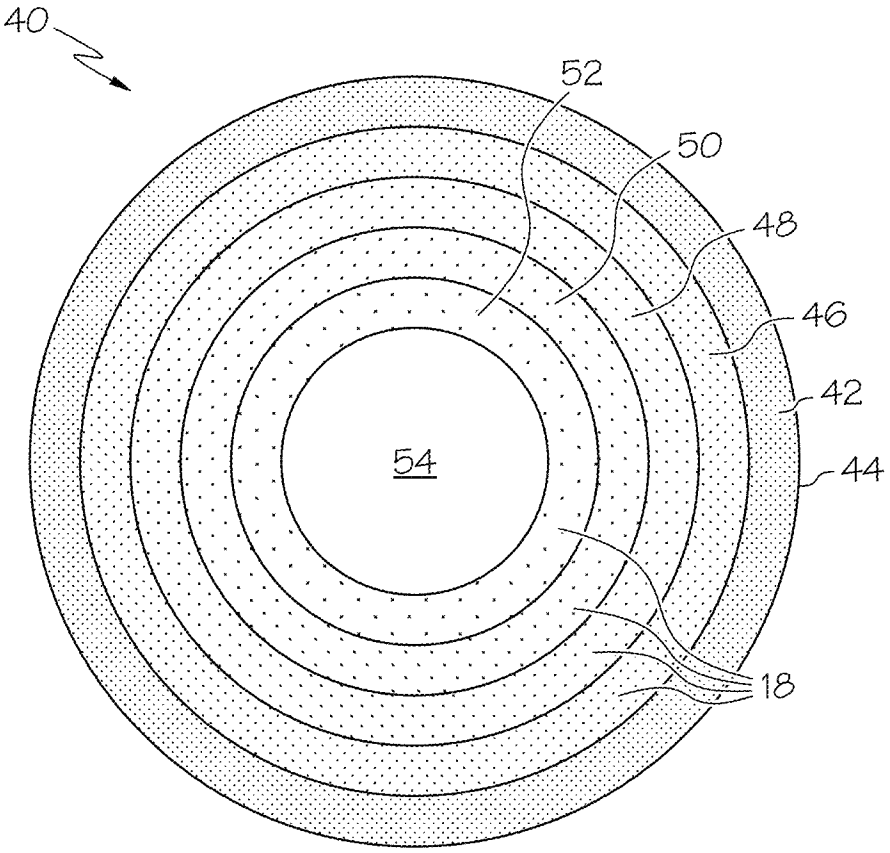
FIG. 6 is a schematic representation an additional non-limiting embodiment of a circular thread rolling die according to the present disclosure, wherein the die includes a sintered cemented carbide region having a layered or gradient construction and a sintered cemented carbide working surface.

Again referring to the schematic illustration of FIG. 6, a non-limiting example of a circular thread rolling die according to the present disclosure may include several regions of different grades of sintered cemented carbide material. Thread rolling die 40 comprises a thread rolling region 42 that includes a working surface 44. The thread rolling region 42 may comprise a cemented carbide grade having mechanical properties suitable for forming threads on workpieces for which the die 40 is intended. In a non-limiting embodiment, the working surface 44 of the thread rolling region 42 has a surface hardness in the range of 78 HRA to 89 HRA, a compressive yield strength greater than 400,000 psi, a stiffness (Young's modulus) greater than $50\times10^6$ psi, and a wear volume (as evaluated by ASTM G65-04) of less than 30 $mm^3$. The non-working region 18 includes a second layer 46 of sintered cemented carbide material adjacent to the thread rolling region 44. The non-working region 18 also includes subsequent layers 48, 50, and 52 having at least one mechanical property or characteristic that differs from the cemented carbide material of the thread rolling region 44 and from one another. Examples of characteristics that may differ between the several layers 46, 48, 50, 52 and the thread rolling region 44 may be one or more of average hard particle size, hard particle composition, hard particle concentration, binder phase composition, and binder phase concentration. Physical and/or mechanical properties that may differ between the several layers 46, 48, 50, 52 and the thread rolling region include, but are not limited to, compressive yield strength, Young's modulus, hardness, toughness, wear resistance, and transverse rupture strength.

In a non-limiting embodiment of thread rolling die 40, the second layer 46 may comprise a cemented carbide grade with hardness less than the hardness of the working surface 44 layer in order to better transfer stresses experienced during the thread rolling operation, and minimize cracking of the sintered cemented carbide material at the working surface 44 and in the thread rolling region 42. Sintered cemented carbide layers 48, 50, 52 progressively decrease in hardness in order to transfer stresses from the relatively harder working surface 44, and thus avoid cracking of the sintered cemented carbide at the working surface 44 and in the thread rolling region 42. In is noted that in the non-limiting embodiment of a circular thread rolling die depicted in FIG. 6, the innermost layer 52 defines a mounting hole 54, which facilitates mounting the thread rolling die to a thread rolling machine (not shown). The innermost layer 52 comprises cemented carbide material having reduced hardness relative to the cemented carbide material of the thread rolling region 42, and this arrangement may better absorb stresses generated during the thread rolling operation and increase the service life of the thread rolling die 40. It will be apparent to those having ordinary skill, upon reading the present disclosure, that a mechanical property other than or in addition to hardness may be varied among the layers of the multi-layer cemented carbide thread rolling die illustrated in FIG. 6. Variation of such other mechanical properties among the layers of a multi-layer thread rolling die such a die 40 are also encompassed within the scope of embodiments of this disclosure.

In a non-limiting embodiment of a thread rolling die comprising a plurality of different grades of cemented carbide arranged in a layered fashion as depicted in FIG. 6, the desired thickness of the thread rolling region 42, the second layer 46, and subsequent layers 48, 50, 52 may be determined by a person of ordinary skill in the art to provide and/or optimize desired properties. A non-limiting example of a minimum thickness range for the thread rolling region 42 may be from 10 mm to 12 mm. Further, while FIG. 6 depicts a thread rolling die comprising five discrete layers 42, 46, 48, 50, 52 of different sintered cemented carbide materials, it is recognized that a thread rolling die of this disclosure may comprise more or less than five layers and/or grades of sintered cemented carbide material depending on the final properties desired. In yet another non-limiting embodiment, instead of comprising discrete layers 42, 46, 48, 50, 52 of sintered cemented carbide material, the layers may be so thin as to provide a substantially continuous gradient of the desired one or more properties from the working surface 44 of the thread rolling region 42 to the innermost layer 52, providing greater stress transferring efficiencies. It will be understood that the foregoing description of possible arrangements and characteristics of thread rolling dies according to the present disclosure including a multi-layered or gradient structure of cemented carbide materials may be applied to circular thread rolling dies, flat thread rolling dies, and thread rolling dies having other configurations.

Certain non-limiting methods for producing articles comprising areas of sintered ceramic carbide materials having differing properties is described in U.S. Pat. No. 6,511,265, which is hereby incorporated by reference herein in its entirety. One such method includes placing a first metallurgical powder blend comprising hard particles and binder particles into a first region of a void of a mold. The mold may be, for example, a dry-bag rubber mold. A second metallurgical powder blend having a different composition comprising hard particles and binder particles is placed into a second region of the void of the mold. Depending on the number of regions of different cemented carbide materials desired in the thread rolling die, the mold may be partitioned into additional regions in which particular metallurgical powder blends are disposed. The mold may be segregated into such regions, for example, by placing physical partitions in the void of the mold to define the several regions. In certain embodiments the physical partition may be a fugitive partition, such as paper, that the partition decomposes and dissipates during the subsequent sintering step. The metallurgical powder blends are chosen to achieve the desired properties in the corresponding regions of the thread rolling die as described above. In certain embodiments, a portion of at least the first region and the second region and any other adjacent regions partitioned in the void of the mold are brought into contact with each other, and the materials within the mold are then isostatically compressed to densify the metallurgical powder blends and form a green compact of consolidated powders. The compact is then sintered to further densify the compact and to form an autogenous bond between the first, second, and, if present, any other regions. The sintered compact provides a blank that may be machined to particular desired thread rolling die geometry. Such geometries are known to those having ordinary skill in the art and are not specifically described herein.

In one non-limiting embodiment of a thread rolling die having a construction as depicted in FIG. 6, one or more of the sintered cemented carbide thread rolling region 42, second layer 46, and additional layers 48, 50, 52 may be comprised of hybrid cemented carbide material. As known to those having ordinary skill, a hybrid cemented carbide comprises a discontinuous phase of a first cemented carbide grade dispersed throughout and embedded in a continuous binder phase of a second cemented carbide grade. As such, a hybrid cemented carbide may be thought of as a composite of different cemented carbides.

In one non-limiting embodiment of a thread rolling die according to the present disclosure, the thread rolling die includes a hybrid cemented carbide in which the binder concentration of the dispersed phase of the hybrid cemented carbide is 2 to 15 weight percent of the dispersed phase, and the binder concentration of the continuous binder phase of the hybrid cemented carbide is 6 to 30 weight percent of the continuous binder phase.

Hybrid cemented carbides included in certain non-limiting embodiments of articles according to the present disclosure may have relatively low contiguity ratios, thereby improving certain properties of the hybrid cemented carbides relative to other cemented carbides. Non-limiting examples of hybrid cemented carbides that may be used in embodiments of thread rolling dies according to the present disclosure are described in U.S. Pat. No. 7,384,443, which is hereby incorporated by reference herein in its entirety. Certain embodiments of hybrid cemented carbide composites that may be included in articles herein have a contiguity ratio of the dispersed phase that is no greater than 0.48. In some embodiments, the contiguity ratio of the dispersed phase of the hybrid cemented carbide may be less than 0.4, or less than 0.2. Methods of forming hybrid cemented carbides having relatively low contiguity ratios include, for example: partially or fully sintering granules of the dispersed grade of cemented carbide; blending these "presintered" granules with the unsintered or "green" second grade of cemented carbide powder; compacting the blend; and sintering the blend. Details of such a method are detailed in the incorporated U.S. Pat. No. 7,384,443 and, therefore, will be known to those having ordinary skill. A metallographic technique for measuring contiguity ratios is also detailed in the incorporated U.S. Pat. No. 7,384,443 and will be known to those having ordinary skill.

Referring now to FIGS. 3-5, according to another aspect of the present disclosure, a thread rolling die 10, 30 according to the present disclosure may include one or more non-cemented carbide regions in non-working regions 18 of the thread rolling die. The non-working regions 18 comprising non-cemented carbide materials may be metallurgically bonded to the thread rolling region 12, which do comprise cemented carbide material, and are positioned so as not to prevent the working surface 14 from contacting the workpiece that is to be threaded. In one non-limiting embodiment, the non-cemented carbide materials in non-working regions comprise at least one of a metal or metal alloy, and a metal matrix composite. In certain non-limiting embodiments, a non-cemented carbide material in the non-working region 18 included in thread rolling die 10,30 may be a solid metallic material selected from iron, iron alloys, nickel, nickel alloys, cobalt, cobalt alloys, copper, copper alloys, aluminum, aluminum alloys, titanium, titanium alloys, tungsten, and tungsten alloys.

In yet another non-limiting embodiment of a thread rolling die according to the present disclosure, the metal matrix composite of the non-cemented carbide piece comprises at least one of hard particles and metallic particles bound together by a metallic matrix material, wherein the melting temperature of the metallic matrix material is less than a melting temperature of the hard particles and/or the metallic particles of the metal matrix composite.

In certain other non-limiting embodiments, a non-cemented carbide piece included in a non-working region 18 of a thread rolling die 10, 30 is a composite material including metal or metallic alloy grains, particles, and/or powder dispersed in a continuous metal or metallic alloy matrix composite. In certain non-limiting embodiments, a non-cemented carbide piece in a non-working region 18 comprises a composite material including particles or grains of a metallic material selected from tungsten, a tungsten alloy, tantalum, a tantalum alloy, molybdenum, a molybdenum alloy, niobium, a niobium alloy, titanium, a titanium alloy, nickel, a nickel alloy, cobalt, a cobalt alloy, iron, and an iron alloy. In one particular non-limiting embodiment, a non-cemented carbide piece in a non-working region 18 included in a thread rolling die 10, 30 according to the present disclosure comprises tungsten grains dispersed in a matrix of a metal or a metallic alloy.

Another non-limiting embodiment of a thread rolling die according to the present disclosure includes a metal matrix composite piece comprising hard particles. A non-limiting embodiment includes a non-cemented carbide piece comprising hard particles of at least one carbide of a metal selected from Groups IVB, VB, and VIB of the Periodic Table. In one non-limiting embodiment, the hard particles of the metal matrix composite comprise particles of at least one of carbides, oxides, nitrides, borides and silicides.

According to one non-limiting embodiment, the metal matrix material includes at least one of copper, a copper alloy, aluminum, an aluminum alloy, iron, an iron alloy, nickel, a nickel alloy, cobalt, a cobalt alloy, titanium, a titanium alloy, a bronze alloy, and a brass alloy. In one non-limiting embodiment, the metal matrix material is a bronze alloy consisting essentially of 78 weight percent copper, 10 weight percent nickel, 6 weight percent manganese, 6 weight percent tin, and incidental impurities. In another non-limiting embodiment, the metal matrix material consists essentially of 53 weight percent copper, 24 weight percent manganese, 15 weight percent nickel, 8 weight percent zinc, and incidental impurities. In non-limiting embodiments, the metal matrix material may include up to 10 weight percent of an element that will reduce the melting point of the metal matrix material, such as, but not limited to, at least one of boron, silicon, and chromium.

In certain embodiments, a non-cemented carbide piece included in a thread rolling die 10, 30 may be machined to include threads or other features so that the thread rolling die 10, 30 may be mechanically attached to a thread rolling machine (not shown).

As depicted in FIGS. 3 and 4, in a non-limiting embodiment, at least one non-cemented carbide piece in a non-working region 18 may be metallurgically bonded to the thread rolling region 12 on an opposite side 56 of the thread rolling region 12, i.e., opposite the working surface 14 of the thread rolling region 12. In other embodiments, as depicted in FIG. 5, at least one non-cemented carbide piece in a non-working region 18 may be metallurgically bonded to the thread rolling region 12 on an adjacent side 58 of the thread rolling region 12, i.e., laterally adjacent to the working surface 14 of the thread rolling region 12. It is recognized that a non-cemented carbide piece can be metallurgically bonded to the sintered cemented carbide thread rolling region 12 at any position that does not prevent the working surface 14 containing the thread form 16 to contact the workpiece.

According to one aspect of the present disclosure, a non-limiting method for forming a sintered cemented carbide thread rolling die that comprises a non-cemented carbide piece or region includes providing a sintered cemented carbide thread rolling region or sintered cemented carbide thread rolling die. Optionally, one or more non-cemented carbide pieces comprising a metal or metal alloy, as disclosed hereinabove may be placed adjacent to a non-working area of the sintered cemented carbide thread rolling region or sintered cemented carbide thread rolling die in a void of a mold. The space between the sintered ceramic thread rolling region or thread rolling die and the optional solid metal or metal alloy pieces defines an unoccupied space. A plurality of inorganic particles are added to at least a portion of the unoccupied space. The inorganic particles may comprise one or more of hard particles, metal grains, particles, and powders The remaining void space between the plurality of inorganic particles and the sintered cemented carbide thread rolling region or thread rolling die and the optional solid metallic pieces defines a remainder space. The remainder space is at least partially filled by infiltration with a molten metal or metal alloy matrix material that has a lower melting temperature than any of the inorganic particles which, together with the inorganic particles, forms a metal matrix composite material. Upon cooling, the metal of the metal matrix composite material bonds together the inorganic particles and the sintered cemented carbide thread rolling die and, if present, any non-cemented carbide metal or metal alloy pieces. Upon removal from the mold, the sintered cemented carbide thread rolling die with a non-cemented carbide piece comprising at least one of a metal or metal alloy region and a metal matrix composite region may be machined and finished to a desired shape. This infiltration process is disclosed in U.S. patent application Ser. No. 12/196,815, which is hereby incorporated herein by reference in its entirety.

Still another non-limiting embodiment of a thread rolling die encompassed by this disclosure comprises a thread rolling region comprising a working surface having a thread form, wherein at least the working surface of the thread rolling region comprises a sintered cemented carbide material, and at least one non-cemented carbide piece is metallurgically bonded to the thread rolling region in an area of the thread rolling region that does not prevent access of a workpiece to the working surface. The non-cemented carbide piece comprises at least one of a metallic region and a metal matrix composite region. The non-cemented carbide piece may be machinable in order to facilitate, for example, mounting of the sintered ceramic thread rolling die to a thread rolling machine.

In a non-limiting embodiment, the sintered cemented carbide of the thread rolling region has a compressive yield strength of at least 400,000 psi, a Young's modulus in the range of $50\times10^6$ psi to $80\times10^6$ psi, an abrasion wear volume in the range of 5 $mm^3$ to 30 $mm^3$ evaluated according to ASTM G65-04, a hardness in the range of 78 HRA to 89 HRA, a fracture toughness of at least 15 $ksi\cdot in^{1/2}$, and a transverse rupture strength of at least 300 ksi.

EXAMPLE 1

Figure 7:
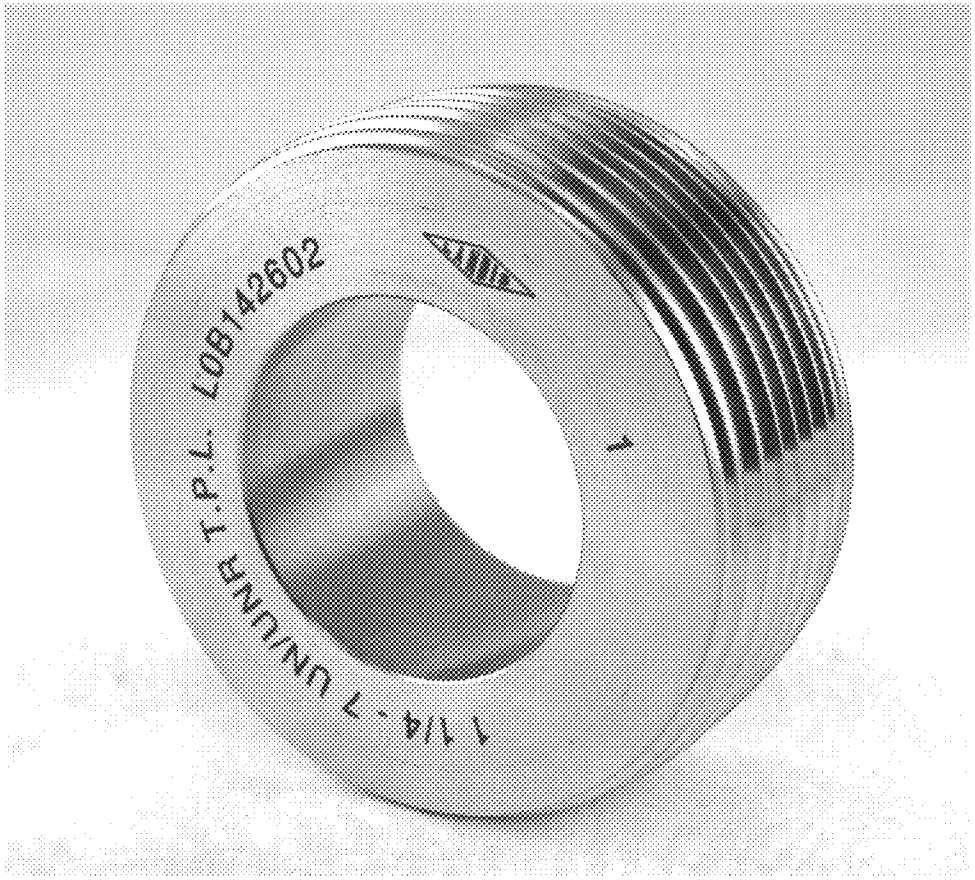
FIG. 7 is photograph of one non-limiting embodiment of a circular thread rolling die according to the present disclosure comprising a sintered cemented carbide material having a hardness in the range of 78 HRA to 89 HRA.

FIG. 7 is a photograph of a thread rolling die made of sintered cemented carbide as embodied in this disclosure. The die consists of a cylindrical sintered cemented carbide ring with the desired thread form on the working surface of the die. A sintered cemented carbide cylindrical part was first made using conventional powder metallurgy techniques by compacting Firth Grade ND-25 metallurgical powder (obtained from ATI Engineered Products, Grant, Ala.) in a hydraulic press using a pressure of 20,000 psi to form a cylindrical blank. High temperature sintering of the cylindrical blank was carried out at 1350° C. in an over-pressure furnace to provide a sintered cemented carbide material including 25% by weight of a continuous binder phase of cobalt and 75% by weight of dispersed tungsten carbide particles. The cylindrical cemented carbide material blank was machined to provide the desired thread form illustrated in FIG. 7 using conventional machine tools and machining practices.

The properties of the thread rolling die illustrated in FIG. 7 include a hardness of 83.0 HRA, a compressive strength of 450,000 psi, a Young's Modulus of $68\times10^6$ psi, and a wear volume of 23 $mm^3$ as measured by ASTM G65-04.

EXAMPLE 2

A circular sintered cemented carbide thread rolling die is prepared as described in Example 1 and is placed in a graphite mold. Powdered tungsten is added to the mold to cover the thread rolling die. An infiltrant powder blend consisting essentially of 78 weight percent copper, 10 weight percent nickel, 6 weight percent manganese, 6 weight percent tin, and incidental impurities is placed in a funnel positioned above the graphite mold. The assembly is placed in a vacuum furnace at a temperature of 1350° C., which is greater than the melting point of the infiltrant powder blend. The molten material formed on melting the infiltrant powder blend infiltrates the space between the tungsten powder and the thread rolling die. As the molten material cools and solidifies, it binds tungsten carbide particles formed from the powdered tungsten to the die and forms a non-cemented carbide non-working portion. Subsequently, the rolling die is machined to form a sintered ceramic thread rolling die comprising a non-cemented carbide non-working region 18 as schematically depicted in FIG. 3. The non-cemented carbide non-working region is machined to facilitate mounting of the thread rolling die onto a thread rolling machine.

It will be understood that the present description illustrates those aspects of the invention relevant to a clear understanding of thread rolling dies according to the present disclosure. Certain aspects that would be apparent to those of ordinary skill in the art and that, therefore, would not facilitate a better understanding of the subject matter herein have not been presented in order to simplify the present description. Although only a limited number of embodiments are necessarily described herein, one of ordinary skill in the art will, upon considering the foregoing description, recognize that many modifications and variations may be employed. All such variations and modifications are intended to be covered by the foregoing description and the following claims.

We claim:

1. A thread rolling die comprising:

a thread rolling region comprising a working surface including a thread form, wherein the thread rolling region comprises a sintered cemented carbide material having a hardness in the range of 78 HRA to 89 HRA, a non-working region comprising one of a layered and a gradient structure comprising at least two different grades of sintered cemented carbide materials, wherein each of the sintered cemented carbide materials in the thread rolling region and non-working region individually comprise hard particles of at least one carbide dispersed in a continuous binder comprising at least one of cobalt, a cobalt alloy, nickel, a nickel alloy, iron, and an iron alloy.

2. The thread rolling die of claim 1, wherein the sintered cemented carbide material of the thread rolling region has a compressive yield strength of at least 400,000 psi.

3. The thread rolling die of claim 1, wherein the sintered cemented carbide material of the thread rolling region has a Young's modulus of at least $50\times10^6$ psi.

4. The thread rolling die of claim 1, wherein the sintered cemented carbide material of the thread rolling region has an abrasion wear volume no greater than 30 $mm^3$ evaluated according to ASTM 065-04.

5. The thread rolling die of claim 1, wherein the sintered cemented carbide material of the thread rolling region has a compressive yield strength of at least 400,000 psi; a Young's modulus of at least $50\times10^6$ psi; and an abrasion wear volume no greater than 30 $mm^3$ evaluated according to ASTM G65-04.

6. The thread rolling die of claim 1, wherein the Young's modulus of the sintered cemented carbide material of the thread rolling region is in the range of $50\times10^6$ psi to $80\times10^6$ psi.

7. The thread rolling die of claim 1, wherein the abrasion wear volume of the sintered cemented carbide material of the thread rolling region is in the range of 5 $mm^3$ to 30 $mm^3$ evaluated according to ASTM G65-04.

8. The thread rolling die of claim 1, wherein the sintered cemented carbide material of the thread rolling region has a fracture toughness of at least 15 ksi-$in^{1/2}$.

9. The thread rolling die of claim 1, wherein the sintered cemented carbide material of the thread rolling region has a transverse rupture strength of at least 300 ksi.

10. The thread rolling die of claim 1, wherein the sintered cemented carbide material of the thread rolling region has a compressive yield strength of at least 400,000 psi; a Young's modulus in the range of $50\times10^6$ psi to $80\times10^6$ psi; an abrasion wear volume in the range of 5 $mm^3$ to 30 $mm^3$ evaluated according to ASTM G65-04; a fracture toughness of at least 15 ksi-$in^{1/2}$; and a transverse rupture strength of at least 300 ksi.

11. The thread rolling die of claim 1, wherein the thread rolling die is selected from the group consisting of a flat thread rolling die and a cylindrical thread rolling die.

12. The thread rolling die of claim 1, wherein the sintered cemented carbide materials of the thread rolling region and non-working region individually comprise hard particles of at least one carbide of a metal selected from Groups IVB, VB, and VIB of the Periodic Table dispersed in a continuous binder comprising at least one of cobalt, a cobalt alloy, nickel, a nickel alloy, iron, and an iron alloy.

13. The thread rolling die of claim 12, wherein the sintered cemented carbide material of the thread rolling region and non-working region individually comprise 60 weight percent up to 98 weight percent of the hard particles and 2 weight percent to 40 weight percent of the continuous binder.

14. The thread rolling die of claim 12, wherein the binder of the sintered cemented carbide materials of the thread rolling region and non-working region individually further comprise at least one additive individually selected from tungsten, chromium, titanium, vanadium, niobium and carbon in a concentration up to the solubility limit of the additive in the binder.

15. The thread rolling die of claim 12, wherein the binder of the sintered cemented carbide materials of the thread rolling region and non-working region further comprise up to 5% by weight of at least one additive individually selected from silicon, boron, aluminum copper, ruthenium, and manganese.

16. The thread rolling die of claim 12, wherein the hard particles have an average grain size in the range of 0.3 μm to 20 μm.

17. The thread rolling die of claim 1, wherein at least the working surface of the thread rolling region comprises a hybrid cemented carbide.

18. The thread rolling die of claim 17, wherein a dispersed phase of the hybrid cemented carbide has a contiguity ratio of less than 0.48.

19. The thread rolling die of claim 1, wherein the thread rolling region comprises one of a layered and a gradient structure comprising different grades of sintered cemented carbide materials.

20. The thread rolling die of claim 1, further comprising at least one non-cemented carbide piece metallurgically bonded to the thread rolling region on a side of the thread rolling region opposite the working surface of the thread rollin region.

21. The thread rolling die of claim 20, wherein the at least one non-cemented carbide piece comprises at least one of a metal or metal alloy region and a metal matrix composite region.

22. The thread rolling die of claim 21, wherein the metal or metal alloy region of the non-cemented carbide piece comprises at least one of nickel, a nickel alloy, cobalt, a cobalt alloy, iron, an iron alloy, titanium, a titanium alloy, copper, a copper alloy, aluminum, and an aluminum alloy.

23. The thread rolling die of claim 21, wherein the metal matrix composite of the non-cemented carbide piece comprises at least one of hard particles and metallic particles bound together by a matrix metal, and wherein a melting temperature of the matrix metal is less than a melting temperature of any of the hard particles and the metallic particles of the metal matrix composite.

24. The thread rolling die of claim 23, wherein the hard particles of the metal matrix composite comprise at least one carbide of a metal selected from Groups IVB, VB, and VIB of the Periodic Table.

25. The thread rolling die of claim 23, wherein the hard particles of the metal matrix composite comprise particles of at least one of carbides, oxides, nitrides, borides and silicides.

26. The thread rolling die of claim 23, wherein the metallic particles of the metal matrix composite comprise grains of at least one of tungsten, a tungsten alloy, tantalum, a tantalum alloy, molybdenum, a molybdenum alloy, niobium, a niobium alloy, titanium, a titanium alloy, nickel, a nickel alloy, cobalt, a cobalt alloy, iron and an iron alloy.

27. The thread rolling die of claim 20, wherein the at least one non-cemented carbide piece is machinable.

28. The thread rolling die of claim 23, wherein the matrix metal comprises at least one of nickel, a nickel alloy, cobalt, a cobalt alloy, iron, an iron alloy, copper, a copper alloy, aluminum, an aluminum alloy, titanium, a titanium alloy, a bronze, and a brass.

29. The thread rolling die of claim 23, wherein the matrix metal comprises a bronze consisting essentially of 78 weight percent copper, 10 weight percent nickel, 6 weight percent manganese, 6 weight percent tin, and incidental impurities.

30. The thread rolling die of claim 1, wherein the thread form comprises at least one of V-type threads, Acme threads, Knuckle threads, and Buttress threads.

31. A thread rolling die, comprising:

a non-working region, and a thread rolling region comprising a working surface including a thread form, wherein the non-working region and the working surface of the thread rolling region individually comprise a sintered cemented carbide material, wherein the sintered cemented carbide material comprises hard particles of at least one carbide of a metal selected from Groups IVB, VB, and VIS of the Periodic Table dispersed in a continuous binder comprising at least one of cobalt, a cobalt alloy, nickel, a nickel alloy, iron, and an iron alloy; and at least one non-cemented carbide piece metallurgically bonded to the thread rolling region in an area of the thread rolling region that does not prevent a workpiece from contacting the working surface, wherein the non-cemented carbide piece comprises a composite material including metal or metallic alloy grains, particles, and/or powder dispersed in a continuous metal or metallic alloy matrix composite.

32. The thread rolling die of claim 31, wherein the sintered cemented carbide of the working surface has a compressive yield strength of at least 400,000 psi, a Young's modulus in the range of $50\times10^6$ psi to $80\times10^6$ psi, an abrasion wear volume in the range of 5 $mm^3$ to 30 $mm^3$ evaluated according to ASTM 065-04, a hardness in the range of 78 HRA to 89 HRA, a fracture toughness of at least 15 ksi-$in^{1/2}$, and a transverse rupture strength of at least 300 ksi.

33. The thread rolling die of claim 20, wherein the at least one non-cemented carbide piece metallurgically bonded to the thread rolling region comprises threads or other features to mechanically attach the thread rolling die to a thread rolling machine.

34. The thread rolling die of claim 31, wherein the at least one non-cemented carbide piece metallurgically bonded to the thread rolling region comprises threads or other features to mechanically attach the thread rolling die to a thread rolling machine.

35. The thread rolling die of claim 1, wherein the sintered cemented carbide material of the thread rolling region has at least one mechanical property or characteristic that differs from the sintered cemented carbide materials of the non-working region.

36. The thread rolling die of claim 35, wherein the sintered cemented carbide materials of the non-working region have a hardness less than a hardness of the sintered cemented carbide material of the thread rolling region.

37. The thread rolling die of claim 1, wherein one of the at least two different grades of sintered cemented carbide materials of the non-working region have at least one mechanical property or characteristic that differs from the other of the at least two different grades of sintered cemented carbide materials of the non-working region.

38. The thread rolling die of claim 37, wherein the at least one characteristic comprises at least one of average hard particle size, hard particle composition, hard particle concentration, binder phase composition, and binder phase concentration.

39. The thread rolling die of claim 37, wherein the at least one mechanical property comprises at least one of compressive yield strength, Young's modulus, hardness, toughness, wear resistance, and transverse rupture strength.

* * * * *